US011780236B2

(12) United States Patent
Koase

(10) Patent No.: US 11,780,236 B2
(45) Date of Patent: Oct. 10, 2023

(54) LIQUID EJECTING APPARATUS AND CONTROL METHOD OF LIQUID EJECTING APPARATUS

(71) Applicant: SEIKO EPSON CORPORATION, Tokyo (JP)

(72) Inventor: Takashi Koase, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 7 days.

(21) Appl. No.: 17/645,343

(22) Filed: Dec. 21, 2021

(65) Prior Publication Data

US 2022/0203694 A1 Jun. 30, 2022

(30) Foreign Application Priority Data

Dec. 24, 2020 (JP) ..... 2020-215324
Feb. 17, 2021 (JP) ..... 2021-023170

(51) Int. Cl.
*B41J 2/175* (2006.01)

(52) U.S. Cl.
CPC ..... *B41J 2/17596* (2013.01); *B41J 2/17563* (2013.01)

(58) Field of Classification Search
CPC .... B41J 2/175; B41J 2/17506; B41J 2/17509; B41J 2/17513; B41J 2/1752; B41J 2/17563; B41J 2/17596; B41J 29/13
See application file for complete search history.

(56) References Cited

U.S. PATENT DOCUMENTS 7,607,770 B2 * 10/2009 Inoue ..... B41J 2/17509 347/85
8,020,983 B2 * 9/2011 Nishimori ..... B41J 2/17596 347/7
8,430,490 B2 * 4/2013 Morita ..... B41J 2/17596 347/85
2003/0007048 A1 * 1/2003 Otsuka ..... B41J 2/17513 347/89
2005/0195246 A1 9/2005 Ogawa
2008/0174645 A1 7/2008 Umeda et al.

FOREIGN PATENT DOCUMENTS

JP 2004-255862 A 9/2004
JP 2005-199600 A 7/2005
JP 2010-179661 A 8/2010
JP 2012-061684 A 3/2012
JP 2017-222061 A 12/2017

* cited by examiner

*Primary Examiner* — Anh T Vo
(74) *Attorney, Agent, or Firm* — WORKMAN NYDEGGER

(57) ABSTRACT

A liquid ejecting apparatus includes a liquid ejecting head that ejects liquid from a nozzle, a liquid storage portion having a storage chamber configured to store the liquid supplied from a liquid supply source to the liquid ejecting head, and a carriage on which the liquid ejecting head and the liquid storage portion are mounted and configured to reciprocate in a scanning direction. The liquid ejecting apparatus includes a discharge flow path configured to discharge air in an upper part of the storage chamber, a coupling portion configured to be coupled to and separated from a coupled portion of the discharge flow path, and a negative pressure generating portion that applies a negative pressure to the coupling portion. When the carriage moves to a predetermined position, the coupling portion is coupled to the coupled portion of the discharge flow path.

12 Claims, 22 Drawing Sheets

LIQUID EJECTING APPARATUS AND CONTROL METHOD OF LIQUID EJECTING APPARATUS

The present application is based on, and claims priority from JP Application Serial Number 2020-215324, filed Dec. 24, 2020 and JP Application Serial Number 2021-023170, filed Feb. 17, 2021, the disclosures of which are hereby incorporated by reference herein in their entirety.

BACKGROUND

1. Technical Field

The present disclosure relates to a liquid ejecting apparatus including a liquid ejecting head and a carriage on which a liquid storage portion is mounted, and a control method of the liquid ejecting apparatus.

2. Related Art

As an example of a liquid ejecting apparatus, an ink jet printer is known in which ink (liquid) supplied from a liquid supply source such as an ink tank is ejected from a liquid ejecting head onto a medium such as paper to print. Among such printers, there is a printer in which a liquid storage portion for storing a liquid such as ink supplied from a liquid supply source to a liquid ejecting head is mounted on a carriage in the middle of a supply path (for example, JP-A-2010-179661).

For example, in the liquid ejecting apparatus described in JP-A-2010-179661, the liquid ejecting head and a buffer tank (an example of the liquid storage portion) are mounted on a reciprocating carriage. The air bubbles from an air bubble storage chamber of the buffer tank to a discharge port of a discharge path are configured to be sucked by a pump via an exhaust cap.

However, in the liquid ejecting apparatus described in JP-A-2010-179661, since it is necessary to dispose the discharge port of the air bubbles next to a nozzle surface of a recording head, there is a problem that a bottom area of the carriage increases, which leads to an increase in the size of the liquid ejecting apparatus.

SUMMARY

According to an aspect of the present disclosure, there is provided a liquid ejecting apparatus including a liquid ejecting head that ejects liquid from a nozzle, a liquid storage portion that includes a storage chamber configured to store the liquid supplied from a liquid supply source to the liquid ejecting head, a carriage on which the liquid ejecting head and the liquid storage portion are mounted and configured to reciprocate in a scanning direction, a discharge flow path configured to discharge air in an upper part of the storage chamber, a coupling portion configured to be coupled to and separated from a coupled portion of the discharge flow path, and a negative pressure generating portion that applies a negative pressure to the coupling portion, in which when the carriage moves to a predetermined position, the coupling portion is coupled to the coupled portion of the discharge flow path.

According to another aspect of the present disclosure, there is provided a liquid ejecting apparatus including a liquid ejecting head that ejects liquid from a nozzle, a liquid storage portion that includes a storage chamber configured to store the liquid supplied from a liquid supply source to the liquid ejecting head, a carriage on which the liquid ejecting head and the liquid storage portion are mounted and configured to reciprocate in a scanning direction, a filter provided upstream of the storage chamber in the liquid storage portion and that filters the liquid supplied from the liquid supply source, a discharge flow path that includes a first discharge flow path configured to discharge air in an upper part of the storage chamber and a second discharge flow path configured to discharge air in at least one of an upper part of a filter chamber in which the filter is housed in the liquid storage portion and an upstream flow path located upstream in a liquid supply direction from the filter in the liquid storage portion, a coupling portion configured to be coupled to and separated from a coupled portion of the discharge flow path, and a negative pressure generating portion that applies a negative pressure to the coupling portion, in which when the carriage moves to a predetermined position, the coupling portion is coupled to the coupled portion of the discharge flow path.

According to still another aspect of the present disclosure, there is provided a control method of a liquid ejecting apparatus that includes a liquid ejecting head ejecting liquid from a nozzle, a liquid storage portion having a storage chamber configured to store the liquid supplied from a liquid supply source to the liquid ejecting head, a carriage on which the liquid ejecting head and the liquid storage portion are mounted and configured to reciprocate in a scanning direction, a discharge flow path configured to discharge air in an upper part of the storage chamber, a first opening/closing portion configured to open and close the discharge flow path, a pressing portion configured to move in a direction of opening and closing the first opening/closing portion, a lever moving the pressing portion in conjunction with a movement of the carriage, an on-off valve provided at a coupled portion of the discharge flow path and configured to open and close the discharge flow path, a coupling portion configured to be coupled to and separated from the coupled portion of the discharge flow path, and a negative pressure generating portion applying a negative pressure to the coupling portion, the method including opening the on-off valve at the coupling portion, and coupling the coupling portion to the coupled portion of the discharge flow path by moving the carriage to a front of a predetermined position, moving the lever in a direction of pressing the pressing portion to open the first opening/closing portion by moving the carriage to the predetermined position, and sucking the air in the storage chamber via the discharge flow path by applying a negative pressure to the coupling portion by the negative pressure generating portion.

According to still another aspect of the present disclosure, there is provided a control method of a liquid ejecting apparatus that includes a liquid ejecting head ejecting liquid from a nozzle, a liquid storage portion having a storage chamber configured to store the liquid supplied from a liquid supply source to the liquid ejecting head, a carriage on which the liquid ejecting head and the liquid storage portion are mounted and configured to reciprocate in a scanning direction, a filter provided upstream of the storage chamber in the liquid storage portion and filtering the liquid supplied from the liquid supply source, a discharge flow path having a first discharge flow path configured to discharge air in an upper part of the storage chamber and a second discharge flow path configured to discharge air in at least one of an upper part of a filter chamber in which the filter is housed in the liquid storage portion and an upstream flow path located upstream in a liquid supply direction from the filter in the liquid storage portion, a coupling portion configured to be coupled to and separated from a coupled portion of the discharge flow path, and a negative pressure generating portion applying a negative pressure to the coupling portion, the method including coupling the coupling portion to the coupled portion of the discharge flow path by moving the carriage to a predetermined position, and sucking the air in the storage chamber via the first discharge flow path, and sucking the air in at least one of the upper part of the filter chamber and the upstream flow path via the second discharge flow path by applying a negative pressure to the coupling portion by the negative pressure generating portion.

DESCRIPTION OF EXEMPLARY EMBODIMENTS

Hereinafter, a first embodiment of a liquid ejecting apparatus will be described with reference to the drawings. The liquid ejecting apparatus of the present embodiment is an ink jet printer that prints (records) a character or an image on a medium by ejecting a liquid such as ink onto the medium such as a paper.

First Embodiment

Figure 1:
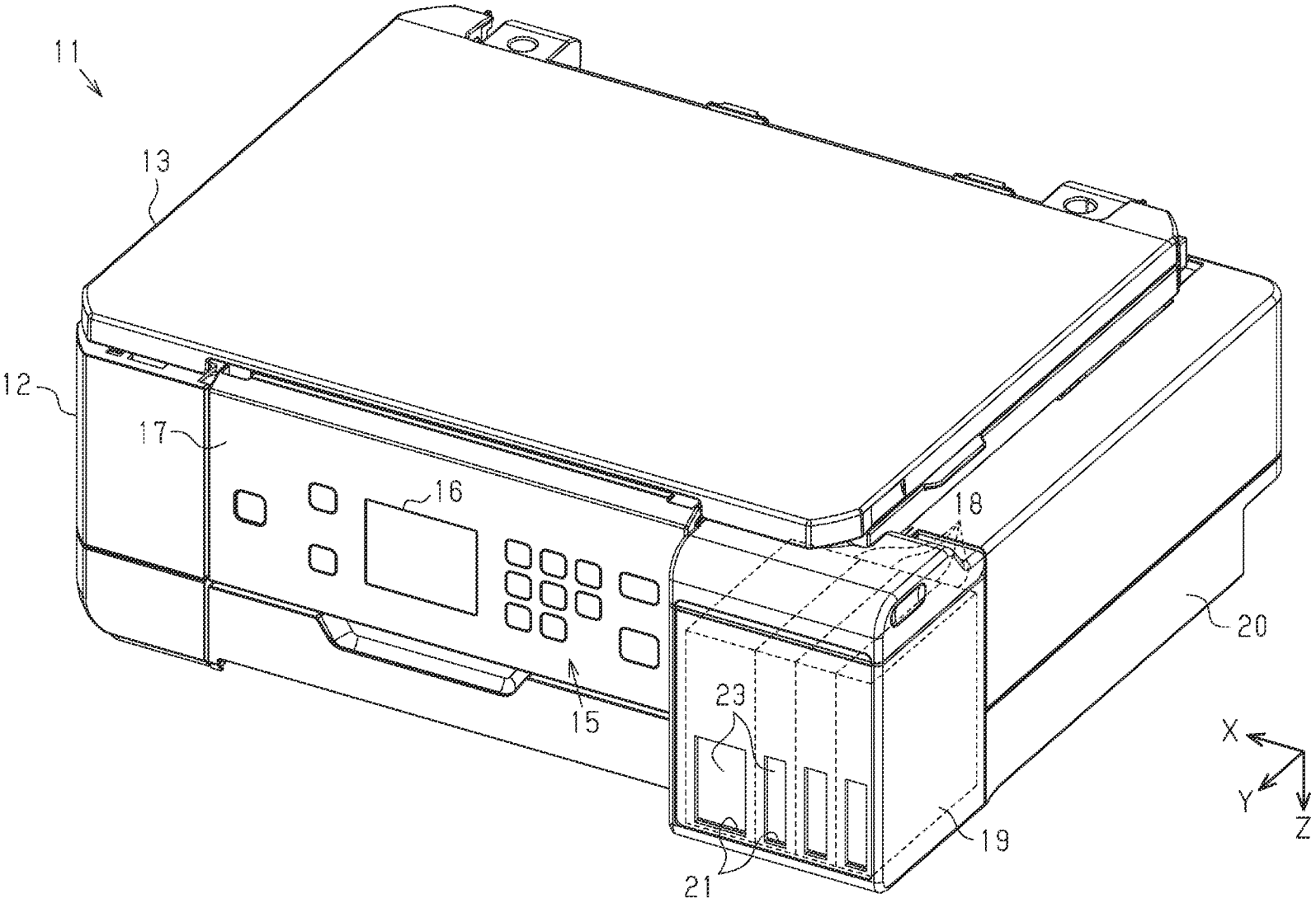
FIG. 1 is a perspective view illustrating a multifunction machine including a liquid ejecting apparatus of a first embodiment.

As illustrated in FIG. 1, a multifunction machine 11 is provided with a liquid ejecting apparatus 12 and an image reading device 13 disposed on the liquid ejecting apparatus 12. In the multifunction machine 11, the image reading device 13 covers an upper side of the liquid ejecting apparatus 12, and has a substantially rectangular parallelepiped shape as a whole.

In FIG. 1, assuming that the multifunction machine 11 is placed on the horizontal plane, the direction of gravity is illustrated by the Z axis and the direction along the horizontal plane perpendicular to the direction of gravity is illustrated by the X axis and the Y axis. The X axis, Y axis, and Z axis intersect each other (orthogonal in the present embodiment). In the following description, the direction along the X axis is also referred to as a scanning direction X, the direction along the Y axis is also referred to as a transport direction Y, and the direction along the Z axis is also referred to as a vertical direction Z. In addition, in the scanning direction X, the direction where the arrow of the X axis is directed is referred to as a +X direction, and the direction opposite thereto is referred to as a −X direction. In the transport direction Y, the direction where the arrow of the Y axis is directed is referred to as a +Y direction, and the direction opposite thereto is referred to as a −Y direction. In addition, the +X direction side is also referred to as a left side, and the −X direction side is also referred to as a right side. Furthermore, the +Y direction side is also referred to as a front side, and the −Y direction side is also referred to as a rear side.

An operation panel 17 including an operation portion 15 such as buttons for performing various operations of the multifunction machine 11, and a display portion 16, which displays information and the like of the liquid ejecting apparatus 12 and the multifunction machine 11, is provided on a front surface of the liquid ejecting apparatus 12.

Furthermore, a holding portion 19 for holding at least one (five in the present embodiment) liquid supply source 18 is provided on a right side of the operation panel 17. The holding portion 19 constitutes a portion of a housing 20, and houses at least one liquid supply source 18 inside the holding portion 19. At least one (five in the present embodiment) window portion 21 is formed in the holding portion 19 so as to correspond to each liquid supply source 18.

Figure 2:
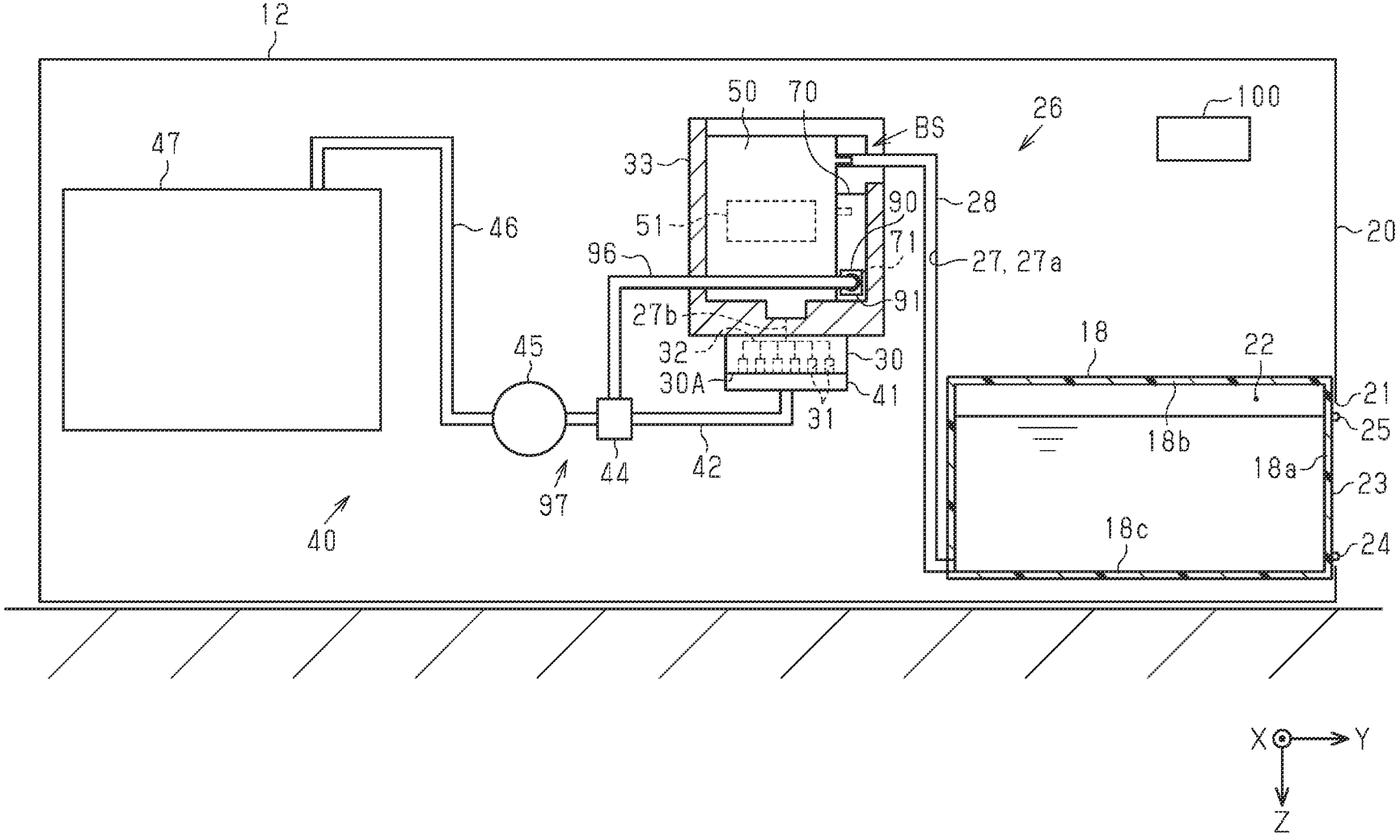
FIG. 2 is a schematic side sectional view illustrating the liquid ejecting apparatus.

As illustrated in FIG. 2, the liquid supply source 18 includes a housing chamber 22 capable of containing a liquid. In the examples illustrated in FIGS. 1 and 2, there are a plurality of liquid supply sources 18, and different types of liquids are contained in the housing chamber 22. The plurality of housing chambers 22 contain, for example, liquids of different colors such as cyan, magenta, yellow, and black. In the present embodiment, as illustrated in FIG. 1, one liquid supply source 18 for black having a large capacity is provided on the operation panel 17 side, and three liquid supply source 18 for color having a smaller capacity than that for black are provided.

The liquid supply source 18 is made of a transparent or translucent resin, and a level of the liquid level of the liquid contained in the housing chamber 22 can be visually recognized from the outside. As illustrated in FIGS. 1 and 2, in the liquid supply source 18, an area corresponding to the window portion 21 functions as a visible surface 23 in which the liquid such as ink in the housing chamber 22 can be visually recognized from the outside. As illustrated in FIG. 2, the visible surface 23 is provided with a lower limit scale 24 indicating a guideline for replenishing the liquid into the housing chamber 22 and an upper limit scale 25 indicating a guideline for an upper limit of the liquid that can be contained in the housing chamber 22. The liquid supply source 18 includes a front wall 18*a* constituting the visible surface 23, and an upper wall 18*b* and a lower wall 18*c* intersecting the front wall 18*a*.

Figure 3:
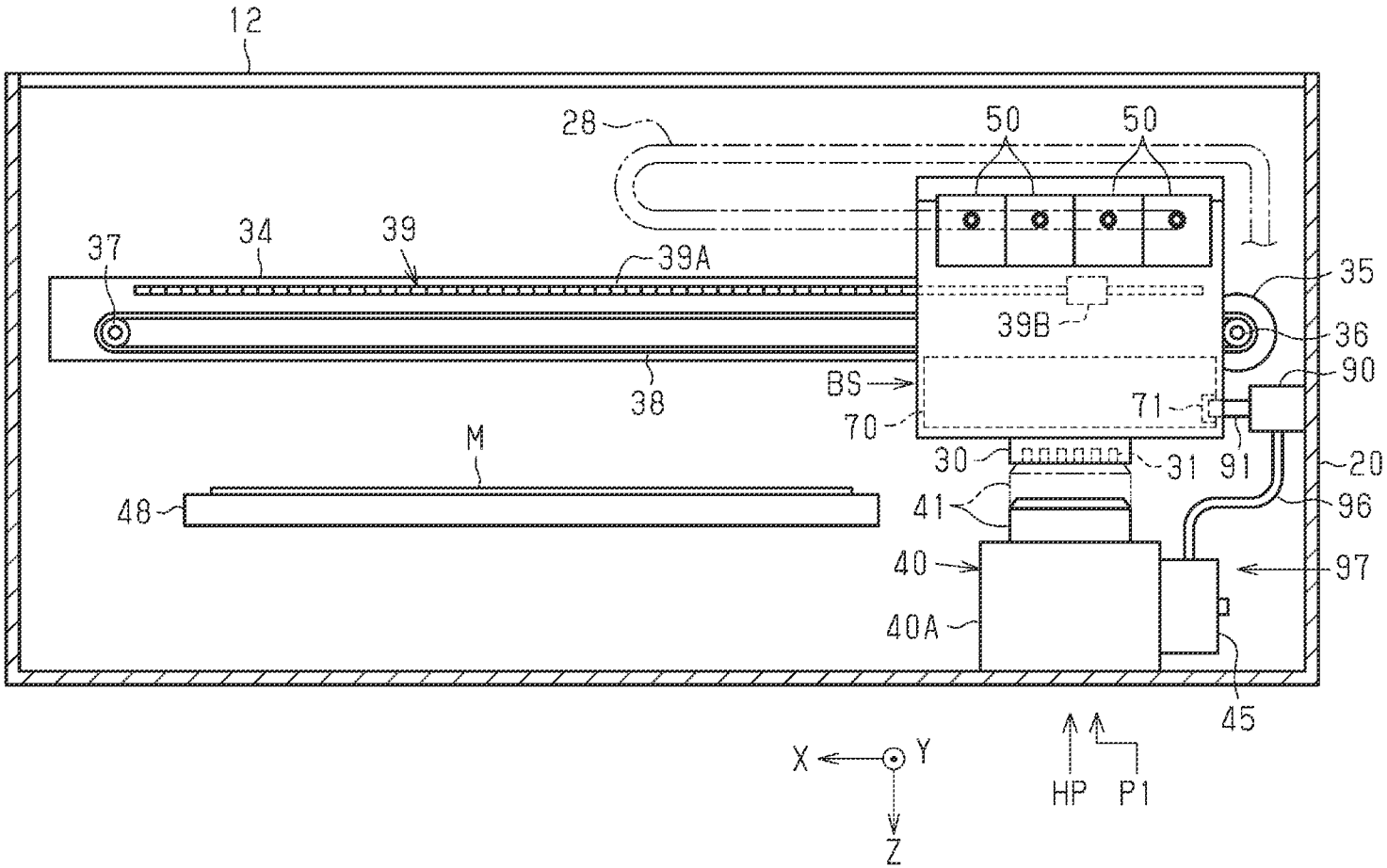
FIG. 3 is a schematic front sectional view illustrating the liquid ejecting apparatus.

As illustrated in FIGS. 2 and 3, the liquid ejecting apparatus 12 is provided with a liquid ejecting head 30 that ejects liquid from a nozzle 31, a liquid storage portion 50 having a storage chamber 51 capable of storing the liquid supplied from the liquid supply source 18 to the liquid ejecting head 30, and a carriage 33 on which the liquid ejecting head 30 and the liquid storage portion 50 are mounted and capable of reciprocating in the scanning direction X. The liquid ejecting head 30 (hereinafter, also simply referred to as "ejecting head 30") ejects a liquid toward the medium M (refer to FIG. 3) while moving, and attaches the ejected liquid to the medium M for printing.

As illustrated in FIG. 2, the liquid ejecting apparatus 12 is provided with a liquid supply device 26 that supplies liquid from the liquid supply source 18 to the ejecting head 30, and a maintenance device 40 that maintains the ejecting head 30.

The maintenance device 40 is provided with a cap 41 provided so as to be movable relative to the ejecting head 30, and a discharge tube 42 coupled to the cap 41. The cap 41 is located below the ejecting head 30. Therefore, the cap 41 can receive the liquid ejected from the nozzle 31 for maintenance and the liquid discharged from the nozzle 31.

The cap 41 is configured to be movable between a retracted position separated from the ejecting head 30 and a capping position in contact with the nozzle surface 30A, which is the surface to which the nozzle 31 of the ejecting head 30 is open. The cap 41 forms a closed space to which the nozzle 31 is open with the nozzle surface 30A when the cap 41 is in the capping position. The cap 41 can form a closed space to which the nozzle 31 is open.

The maintenance device 40 is provided with a suction pump 45 provided in the middle of the discharge tube 42. The liquid ejecting apparatus 12 is provided with a waste liquid housing portion 47 to which a downstream end of the discharge tube 46 extending from the suction pump 45 of the maintenance device 40 is coupled. The maintenance device 40 drives the suction pump 45 with the cap 41 separated from the ejecting head 30, and sends the liquid received by the cap 41 to the waste liquid housing portion 47.

In addition, the maintenance device 40 drives the suction pump 45 with the ejecting head 30 capped to reduce the pressure in the closed space formed between the cap 41 and the nozzle surface 30A. As a result, the maintenance device 40 discharges foreign matter such as air bubbles in the liquid in the ejecting head 30 from the nozzle 31 together with the liquid and sends the foreign matter and the liquid to the waste liquid housing portion 47.

Next, the liquid supply device 26 will be described.

As illustrated in FIG. 2, a plurality of liquid supply devices 26 (four in the present embodiment) are provided individually corresponding to the liquid supply source 18, and in FIG. 2, for simplification of the figure, one liquid supply source 18 and one liquid supply device 26 corresponding to the liquid supply source 18 are illustrated. Since each configuration of the plurality of liquid supply devices 26 provided is substantially the same, the description of one liquid supply device 26 will be described and the description of the other liquid supply devices 26 will be omitted.

As illustrated in FIG. 2, the liquid supply device 26 is provided with a liquid supply path 27 that supplies the liquid contained in the liquid supply source 18 to the ejecting head 30, and the above-described liquid storage portion 50 provided in the middle of the liquid supply path 27 and capable of storing liquid. The liquid storage portion 50 is mounted on the carriage 33 and reciprocates in the scanning direction X as the carriage 33 moves. The liquid storage portion 50 stores the liquid and changes the volume of the stored liquid in response to a change in the pressure of the liquid.

The liquid supply path 27 may be formed of an elastically deformable tube, or may be formed of a flow path forming member made of a hard resin material. The liquid supply path 27 may be formed by attaching a film member to the flow path forming member in which a groove is formed.

The liquid supply path 27 includes a first supply path 27*a* which is a portion upstream of the liquid storage portion 50 and a second supply path 27*b* which is a portion downstream of the liquid storage portion 50. The liquid supply device 26 is provided with a supply tube 28 that couples the liquid storage portion 50 and the liquid supply source 18. The first supply path 27*a* is formed in the supply tube 28. The second supply path 27*b* is provided on the carriage 33, and sends the liquid from the liquid storage portion 50 to the ejecting head 30.

As illustrated in FIG. 2, the liquid storage portion 50 is located above the ejecting head 30 and the liquid supply source 18, and at least a portion of the liquid supply source 18 is located below the ejecting head 30. That is, the ejecting head 30 is located between the liquid storage portion 50 and the liquid supply source 18 in the vertical direction Z. The positional relationship between the liquid storage portion 50, the ejecting head 30, and the liquid supply source 18 in the vertical direction Z can be randomly set as long as the liquid can be ejected from the nozzle 31 of the ejecting head 30 at the ejection timing and the liquid does not leak from the nozzle 31 of the ejecting head 30 at the non-ejection timing such as during standby.

As illustrated in FIG. 2, the carriage 33 is equipped with a bubble discharge mechanism BS capable of discharging air above the storage chamber 51 of the liquid storage portion 50. The bubble discharge mechanism BS is provided with a coupled portion 71 (refer to FIG. 9) of a discharge flow path F (refer to FIG. 5) communicating with the upper part of the storage chamber 51, and a coupling portion 91 that can be coupled to and separated from the coupled portion 71 of the discharge flow path F. In addition, the liquid ejecting apparatus 12 is provided with a negative pressure generating portion 97 (refer to FIGS. 2 and 3) that applies a negative pressure to the coupling portion 91. The negative pressure generating portion 97 communicates with the cap 41.

When the carriage 33 is in a predetermined position in the scanning direction X, the bubble discharge mechanism BS is configured so that the coupled portion 71 and the coupling portion 91 can be coupled to each other.

As illustrated in FIG. 2, the negative pressure generating portion 97 may divert the suction pump 45 of the maintenance device 40 as the negative pressure source. In this case, a switching valve 44 is provided in the middle of the discharge tube 42, and the switching valve 44 and the bubble discharge mechanism BS are coupled to each other through a discharge tube 96. The switching valve 44 is, for example, an electromagnetic switching valve, and is switched and controlled by a control portion 100. The switching valve 44 is configured to be switchable between a first switching position for introducing the negative pressure from the suction pump 45 into the cap 41 and a second switching position for introducing the negative pressure from the suction pump 45 into the storage chamber 51 and a filter chamber 54 in the liquid storage portion 50 via the coupling between the coupling portion 91 and the coupled portion 71 of the bubble discharge mechanism BS.

Configuration of Scanning System

Next, a configuration of a scanning system in the liquid ejecting apparatus 12 will be described with reference to FIG. 3.

As illustrated in FIG. 3, the carriage 33 is provided so as to be reciprocally movable along the scanning direction X parallel to the width direction X intersecting the transport direction Y to which the medium M is transported. The carriage 33 is provided so as to be reciprocally movable in the scanning direction X along a guide rail 34. The guide rail 34 is, for example, formed by forming a portion of a metal main frame into a rail shape, or is formed by a guide shaft erected so as to extend in the scanning direction X in the housing 20.

In the housing 20, a carriage motor 35 that is a drive source of the carriage 33 is disposed at a position which is one end portion of a movement path of the carriage 33. An endless timing belt 38 is mounted between a drive pulley 36 fixed to a drive shaft of the carriage motor 35 and a driven pulley 37 located at an end portion opposite to the drive pulley in the scanning direction X. The carriage 33 is fixed to a portion of the timing belt 38. Therefore, when the carriage motor 35 is driven in the forward rotation, the carriage 33 moves forward in the +X direction, and when the carriage motor 35 is driven in the reverse direction, the carriage 33 moves rearward in the −X direction.

In addition, a linear encoder 39 extending along the movement path of the carriage 33 is provided in the housing 20. The linear encoder 39 includes a linear scale 39A extending along the movement path of the carriage 33 and a sensor 39B attached to the carriage 33 so as to be able to detect light transmitted through a translucent portion formed on the linear scale 39A at a constant pitch. The sensor 39B detects the linear scale 39A and outputs an encoder signal including the number of pulse signals proportional to the moving distance of the carriage 33 to the control portion 100.

In addition, as illustrated in FIG. 3, the carriage 33 is equipped with the ejecting head 30 and the liquid storage portion 50. In the present embodiment, the carriage 33 is equipped with a plurality of liquid storage portions 50. The plurality of liquid storage portions 50 are mounted on the carriage 33 in a state of being arranged in the scanning direction X. Each of the plurality of liquid storage portions 50 includes a supply pipe portion 52 for supplying liquid. The other end portion of the supply tube 28, one end portion of which is coupled to a plurality of liquid supply sources 18 corresponding to each of the supply pipe portions 52, is coupled to the supply pipe portion 52 of each liquid storage portion 50. Therefore, the liquids of each color are supplied to the plurality of liquid storage portions 50 from the plurality of liquid supply sources 18 corresponding to each of the plurality of liquid storage portions 50. In the present example, cyan, magenta, yellow, and black liquids (inks) are supplied to the plurality of liquid storage portions 50, respectively. The liquid in each liquid storage portion 50 is supplied to the ejecting head 30. Each liquid storage portion 50 supplies the liquid stored in the storage chamber 51 to the ejecting head 30 at a pressure within a predetermined range. That is, the liquid storage portion 50 has a function of a pressure regulating valve that regulates the supplied liquid to a pressure within a predetermined range and supplies the liquid to the ejecting head 30. The detailed configuration of the liquid storage portion 50 that functions as the pressure regulating valve will be described later.

The carriage 33 illustrated in FIG. 3 is located at a home position HP, which is a standby position at the time of non-printing. At the time of printing, the medium M supplied from a cassette is transported in the transport direction Y in a state of being supported by a support stand 40 (for example, platen). The control portion 100 drives the carriage motor 35 to reciprocate the carriage 33 in the scanning direction X. The ejecting head 30 ejects the liquid while moving in the scanning direction X toward the medium M transported on a support stand 48, so that characters or images are printed on the surface of the medium M.

In addition, in the housing 20, the maintenance device 40 is disposed below the carriage 33 located at the home position HP illustrated in FIG. 3. The maintenance device 40 is provided with a main body 40A and the above-described cap 41 provided so as to be able to move up and down with respect to the main body 40A. The cap 41 moves up and down between the retracted position illustrated by the solid line in FIG. 3 and the capping position illustrated by the two-dot chain line in FIG. 3. When the cap 41 raised to the capping position comes into contact with the nozzle surface 30A to which the nozzle 31 of the ejecting head 30 is open, a closed space is formed between the nozzle surface 30A and the cap 41. When the suction pump 45 is driven into this closed space, a negative pressure is introduced, so that the liquid is forcibly sucked and discharged from the nozzle 31. At this time, foreign matter such as thickening ink, air bubbles, and paper dust is discharged from the nozzle 31 together with the liquid, so that clogging of the nozzle 31 is prevented or eliminated. When the carriage 33 stands by at the home position HP at the time of non-printing, the cap 41 raised to the capping position comes into contact with the nozzle surface 30A, and the space communicating with the opening of the nozzle 31 is a closed space surrounded by the cap 41. Therefore, evaporation of water from the liquid in the nozzle 31 is suppressed. In addition, the inside of the cap 41 may be moisturized with a moisturizer.

As illustrated in FIG. 3, the bubble discharge mechanism BS includes the coupled portion 71 which is located on the side portion of the carriage 33, and the coupling portion 91 that can be coupled to the coupled portion 71 when the carriage 33 is in a bubble discharge treatment position. The coupling portion 91 is fixed to an inner wall surface of the housing 20 or a side frame (not illustrated) disposed in the housing 20. The coupled portion 71 and the coupling portion 91 are located so as to face the scanning direction X, which is the moving direction of the carriage 33.

The coupling portion 91 extends in the scanning direction X at a predetermined position. The coupled portion 71 of the discharge flow path F is open to a position facing the coupling portion 91 in the scanning direction X. The predetermined position is a bubble discharge position P1.

In the process of moving the carriage 33 to the bubble discharge position P1 as an example of a predetermined position which is a position on the −X direction side of the home position HP illustrated in FIG. 3, the coupled portion 71 and the coupling portion 91 are coupled to each other stepwise. Detailed configuration of the coupling portion 91 and the coupled portion 71 and the details of the coupling process coupled stepwise will be described later.

Figure 4:
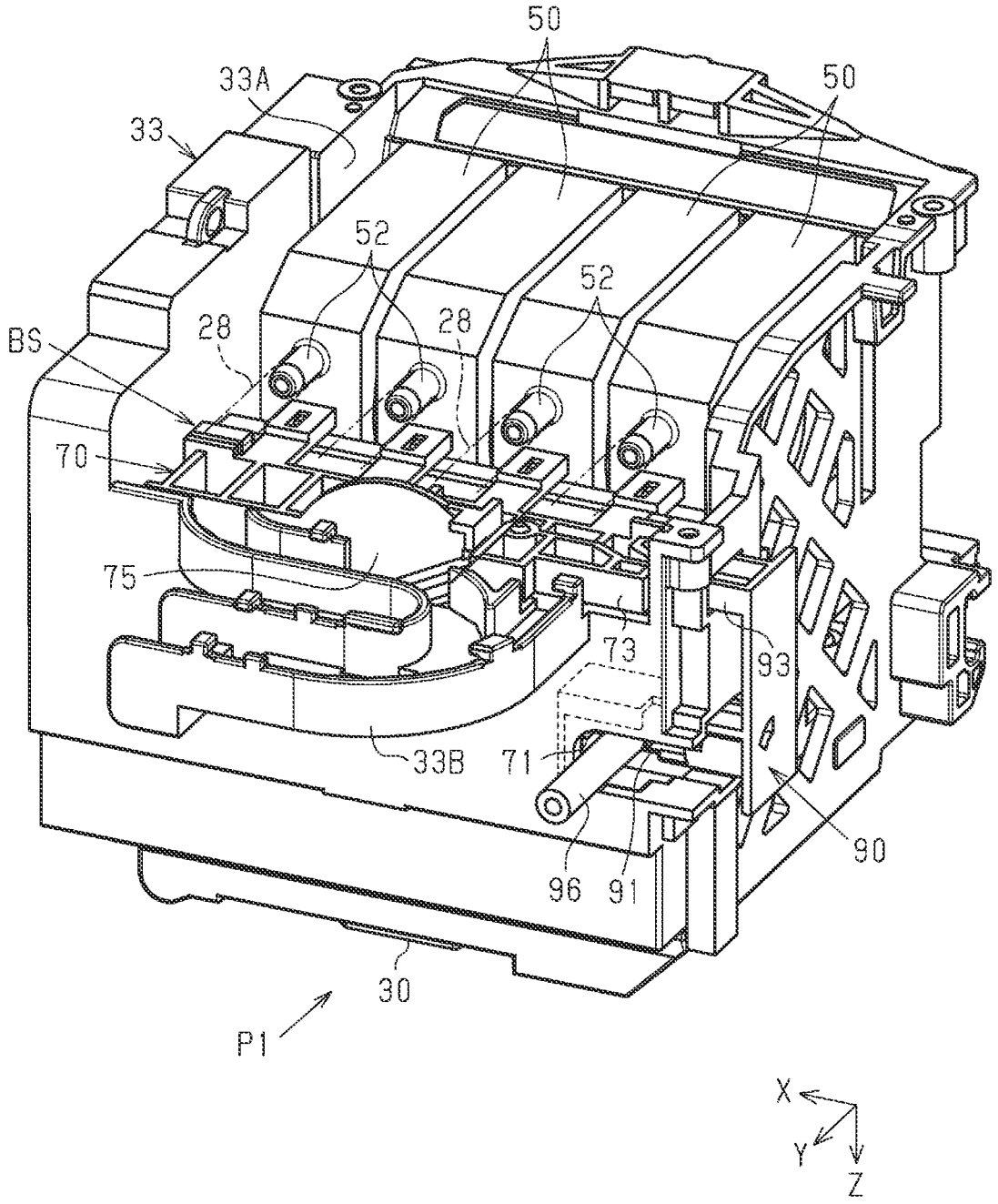
FIG. 4 is a perspective view illustrating a carriage on which a liquid storage portion and a liquid ejecting head are mounted.

FIG. 4 illustrates a state where the carriage 33 is located at the bubble discharge position P1. As illustrated in FIG. 4, the carriage 33 includes a housing recessed portion 33A at the upper part, and a plurality of liquid storage portions 50 are mounted in the housing recessed portion 33A in a state of being arranged in the scanning direction X. When the plurality of liquid storage portions 50 are mounted on the inside of the housing recessed portion 33A, each supply pipe portion 52 is exposed to the outside of the carriage 33. Therefore, it is possible to couple the end portion of the supply tube 28 to each supply pipe portion 52. A guide member 33B is formed on the front portion of the carriage 33 to guide a plurality of supply tubes 28 coupled to each supply pipe portion 52 along a predetermined guide path.

In addition, when the carriage 33 is at the bubble discharge position P1 illustrated in FIG. 4, the coupled portion 71 and the coupling portion 91 are coupled to each other. In this coupling state, a negative pressure is introduced into the upper part of the storage chamber 51 in the liquid storage portion 50 via the discharge tube 96 and an air exhaust valve mechanism 70. When there are air bubbles in the upper part of the storage chamber 51, the air bubbles are sucked and removed through the air exhaust valve mechanism 70 and the discharge tube 96 by the introduced negative pressure.

Electrical Configuration of Liquid Ejecting Apparatus

The control portion 100 acquires the carriage position, which is the position of the carriage 33 in the scanning direction X, based on the count value of a counter by causing the counter to count the number of pulse edges of the encoder signal input from the linear encoder 39. The control portion 100 performs a speed control and a position control when the carriage 33 moves based on the acquired carriage position.

When the maintenance is performed, the control portion 100 drives the suction pump 45 with the switching valve 44 switched to the first switching position. On the other hand, at the time of bubble discharge treatment, the control portion 100 drives the suction pump 45 in a state where the switching valve 44 is switched to the second switching position, and drives the carriage motor 35 to move the carriage 33 to a predetermined position where the bubble discharge treatment is performed.

Here, the predetermined position may be the home position HP, which is the standby position where the carriage 33 stands by at the time of non-printing, or may be a position different from the home position HP. For example, the predetermined position may be a position on the −X direction side of the home position HP. With this configuration, it is possible to avoid that the bubble discharge treatment is performed every time the carriage 33 stands by at the home position HP. In addition, it is possible to prevent the bubble discharge treatment from being performed every time maintenance of the carriage 33 is performed at the home position HP.

Since the growth of air bubbles is very slow, the frequency of bubble discharge treatment may be less than the maintenance frequency. When the frequency of the bubble discharge treatment is excessively increased, the liquid (ink) in the liquid storage portion 50 is unnecessarily discharged due to the suction force exerted on the discharge flow path F even though there are substantially no air bubbles. In order to avoid this discharge, the bubble discharge treatment is performed less frequently than the maintenance frequency, so that the bubble discharge treatment position may be set at a position different from the maintenance position (for example, home position HP) where the maintenance is performed, and not passing on the way from the print region to the maintenance position.

Furthermore, as illustrated in FIG. 2, the liquid ejecting apparatus 12 is provided with the control portion 100 that controls the overall operation of the multifunction machine 11. The control portion 100 controls an operation of reciprocating the carriage 33, an operation of transporting the medium M, an operation of ejecting the liquid from the nozzle 31 to the ejecting head 30, and a discharge operation (cleaning) of sucking and discharging the liquid from the nozzle 31 in order to maintain normal printing.

Liquid Storage Portion

Next, the detailed configuration of the liquid storage portion 50 will be described with reference to FIGS. 5 to 8. Since the plurality of liquid storage portions 50 all have the same configuration, one liquid storage portion 50 will be described below.

Figure 5:
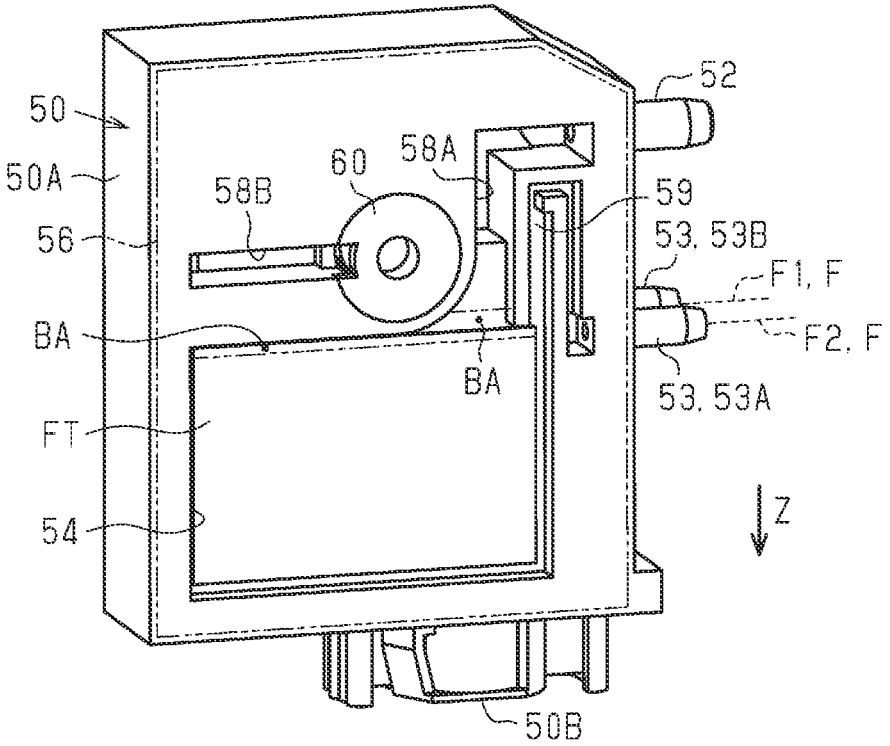
FIG. 5 is a perspective view illustrating a first surface of the liquid storage portion.

As illustrated in FIG. 5, the liquid storage portion 50 includes the storage chamber 51 capable of storing the liquid supplied from the liquid supply source 18 to the liquid ejecting head 30. The liquid storage portion 50 includes the supply pipe portion 52 in which the liquid from the liquid supply source 18 is supplied to the storage chamber 51. In addition, the liquid storage portion 50 includes the discharge pipe portion 53 for discharging air bubbles in the storage chamber 51. The liquid storage portion 50 of the present example includes a pressure chamber 55 illustrated in FIG. 6 as the storage chamber 51.

Figure 6:
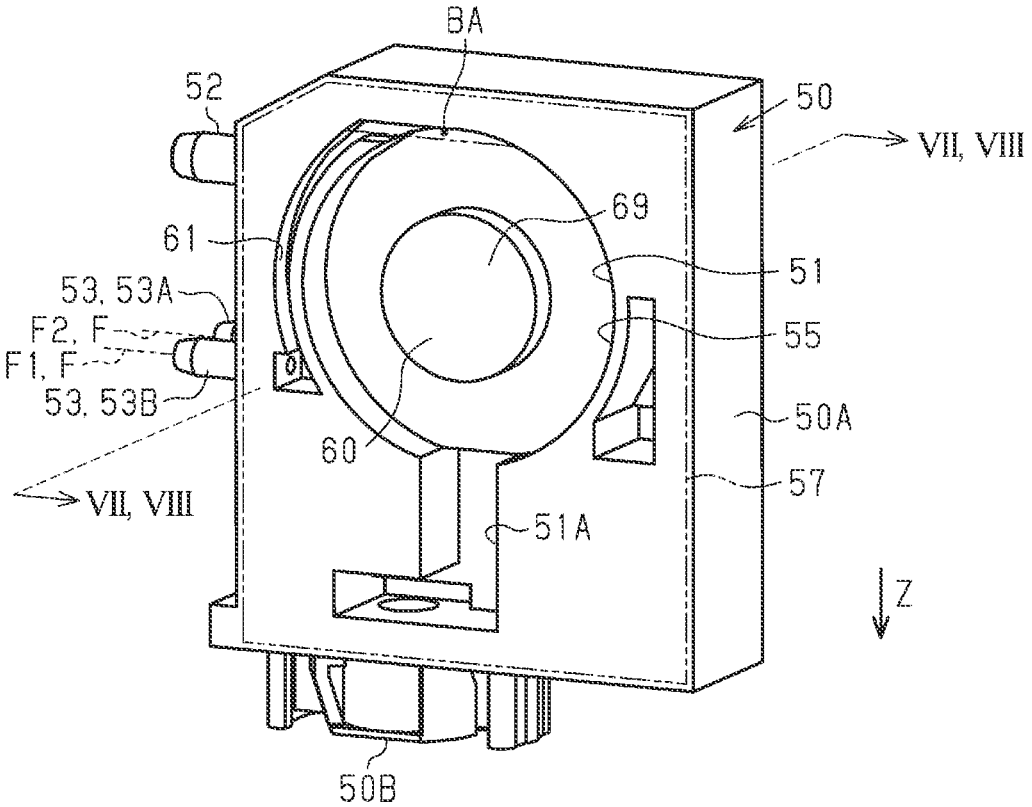
FIG. 6 is a perspective view illustrating a second surface of the liquid storage portion.

The liquid storage portion 50 includes a main body 50A having a recessed portion forming an inner wall surface of the storage chamber and having a substantially rectangular plate shape, and a pair of films 56 and 57 fixed to a first surface, which is one surface of the main body 50A, and a second surface, which is the other surface, respectively. As illustrated in FIGS. 5 and 6, the liquid storage portion 50 of the present example includes a plurality of discharge pipe portions 53. Hereinafter, one discharge pipe portion 53 is also referred to as a first discharge pipe portion 53A, and the other discharge pipe portion 53 is also referred to as a second discharge pipe portion 53B.

Specifically, as illustrated in FIG. 5, a recessed portion forming a portion of the inner wall surface of the storage chamber 51 is recessed on the first surface of the main body 50A, and the opening of the recessed portion is covered with the first film 56. Therefore, the filter chamber 54, the supply flow path 58A communicating with the filter chamber 54, and a discharge flow path 59 (also referred to as "second discharge flow path 59") are formed. The supply flow path 58A communicates between the supply pipe portion 52 and the filter chamber 54. In addition, the second discharge flow path 59 communicates between the filter chamber 54 and the first discharge pipe portion 53A (53). A filter FT is housed in the filter chamber 54. That is, the liquid ejecting apparatus 12 is provided upstream of the storage chamber 51 in the liquid storage portion 50, and is provided with the filter FT that filters the liquid supplied from the liquid supply source 18. In addition, the liquid passed through the filter FT is supplied to a supply chamber 64 through the supply flow path 58B that communicates with the filter chamber 54 downstream thereof. The supply chamber 64 is provided with a pressure regulating mechanism 60. In addition, the second discharge flow path 59 discharges air bubbles accumulated in the upper part of the filter chamber 54 and air bubbles staying in a portion near the filter chamber 54 in the supply flow path 58A, which is an example of an upstream flow path communicating with the filter chamber 54 on the upstream thereof.

Therefore, the opening at the end portion of the discharge flow path 59 on the filter chamber 54 side is located at a portion where air bubbles are likely to accumulate. In the present example, by introducing the negative pressure from the negative pressure generating portion 97 described later into the first discharge pipe portion 53A, the air bubbles accumulated in the upper part of the filter chamber 54 are sucked and discharged to the outside through the discharge flow path 59.

The discharge flow path F of the present embodiment includes a first discharge flow path 61 capable of discharging air in the upper part of the storage chamber 51, and a second discharge flow path 59 capable of discharging air in at least one of the upper part of the filter chamber 54 in which the filter FT is housed in the liquid storage portion 50 and the upstream flow path located upstream in the liquid supply direction from the filter FT in the liquid storage portion 50.

In addition, as illustrated in FIG. 6, a recessed portion forming a portion of the inner wall surface of the pressure chamber 55 is recessed on the second surface of the main body 50A, and the opening of the recessed portion is covered with the second film 57. Therefore, the pressure chamber 55, the supply flow path 51A communicating with the pressure chamber 55, and the discharge flow path 61 (also referred to as "first discharge flow path 61") are formed. In the pressure chamber 55, a pressure receiving plate 69 constituting the pressure regulating mechanism 60 is disposed. The supply flow path 51A extends downward (in the direction of gravity) from the pressure chamber 55 and communicates with the supply port of the supply portion 50B protruding downward from a bottom portion of the main body 50A. In addition, the discharge flow path 61 extends from the upper part of the pressure chamber 55 and communicates with the second discharge pipe portion 53B. The first discharge flow path 61 discharges air bubbles accumulated in the upper part of the pressure chamber 55.

Therefore, the opening at the end portion of the first discharge flow path 61 on the pressure chamber 55 side is located at a portion where air bubbles are likely to accumulate. In the present example, by introducing the negative pressure from the negative pressure generating portion 97 described later into the second discharge pipe portion 53B, the air bubbles accumulated in the upper part of the pressure chamber 55 are sucked and discharged to the outside through the first discharge flow path 61.

The filter FT illustrated in FIG. 5 includes multiple holes which are mesh through which the liquid can pass. As the filter FT, for example, a mesh-like body such as a wire mesh or a resin mesh, a porous body, or a metal plate having fine through-holes can be used. Specific examples of the mesh-like body include a metal mesh filter and metal fibers. The mesh filter is a filter formed by weaving a wire, and there are filters such as plain weave, twill weave, plain weave, and twill weave.

Pressure Regulating Mechanism

Next, the pressure regulating mechanism of the liquid storage portion 50 will be described with reference to FIGS. 7 and 8.

Figure 7:
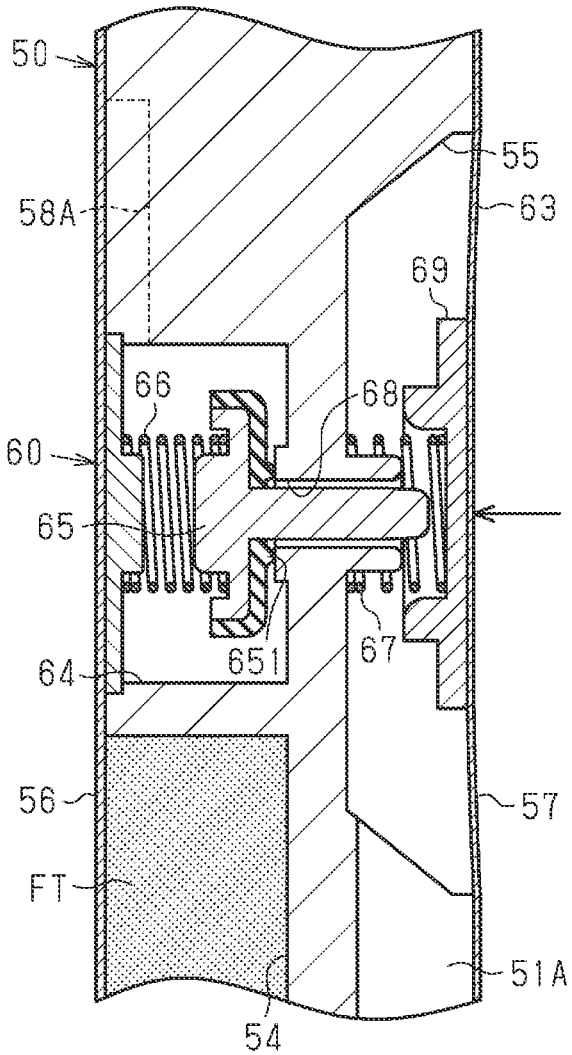
FIG. 7 is a cross-sectional view taken along arrow line VII,VIII-VII,VIII in FIG. 6 of the liquid storage portion with a valve closed.
Figure 8:
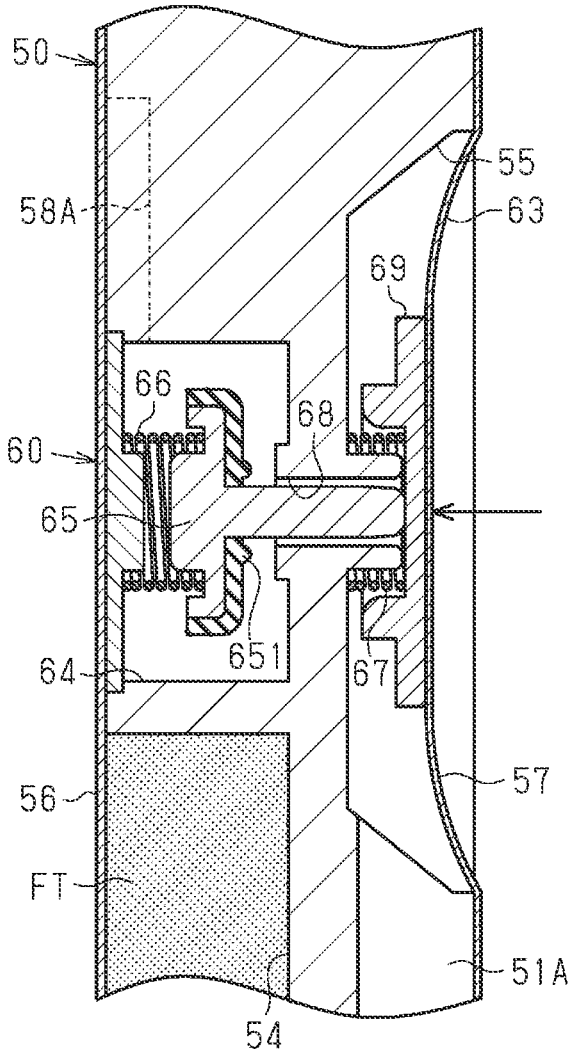
FIG. 8 is a cross-sectional view taken along arrow line VII,VIII-VII,VIII in FIG. 6 of the liquid storage portion with a valve open.

As illustrated in FIGS. 7 and 8, the liquid storage portion 50 is provided in the middle of the liquid supply path 27, and regulates the pressure of the ink in the nozzle 31 for each nozzle row (for each color).

As illustrated in FIG. 7, the liquid storage portion 50 is provided with the pressure chamber 55 in which a movable wall 63 displaceable in a direction of changing the volume forms a portion of the wall surface, the supply chamber 64, a valve body 65, a first biasing member 66 for biasing the valve body 65 in the supply chamber 64, and a second biasing member 67 for biasing the movable wall 63 toward the outside of the pressure chamber 55 in the pressure chamber 55.

The pressure chamber 55 includes an inflow hole 68 for flowing the supplied ink and a supply flow path 51A communicating with the nozzle 31 via a common liquid chamber 32 at a position different from the movable wall 63. The supply chamber 64 can communicate with the pressure chamber 55 via the inflow hole 68. A base end portion of the valve body 65 is disposed in the supply chamber 64, and a tip end portion of the valve body 65 protrudes into the pressure chamber 55 through the inflow hole 68. The valve body 65 is biased toward the closed position by the first biasing member 66 housed in the supply chamber 64 in a state where a seal portion 651 provided at the base end portion can be displaced to a closed position (position illustrated in FIG. 7) for closing the inflow hole 68 and an open position (position illustrated in FIG. 8) for opening the inflow hole 68. In addition, one end of the second biasing member 67 comes into contact with the pressure receiving plate 69 attached to the movable wall 63, and the other end is disposed so as to surround the tip end portion of the valve body 65 protruding into the pressure chamber 55.

The valve body 65 of the liquid storage portion 50 is biased by the first biasing member 66 housed in the supply chamber 64, so that the valve body 65 does not move to the open position even when the pressure of the supply chamber 64 rises. On the other hand, when the pressure in the pressure chamber 55 is lower than a predetermined pressure due to the outflow of ink from the supply flow path 51A, the movable wall 63 is displaced toward the inside of the pressure chamber 55, and the pressure receiving plate 69 pushes the tip end of the valve body 65, so that the valve body 65 moves to the open position. As a result, the ink in the supply chamber 64 flows into the pressure chamber 55 through the inflow hole 68, so that the pressure in the pressure chamber 55 rises.

When the movable wall 63 is displaced toward the outside of the pressure chamber 55 due to the pressure increase in the pressure chamber 55 and the pressure receiving plate 69 is separated from the tip end of the valve body 65, the valve body 65 moves from the open position to the closed position.

Here, when the pressure receiving plate 69 approaches the tip end of the valve body 65, the second biasing member 67 pushes the pressure receiving plate 69 back in the direction separated from the tip end of the valve body 65.

Therefore, when the pressure in the pressure chamber 55 drops and the pressure receiving plate 69 presses the tip end of the valve body 65 against the biasing force of the first biasing member 66 and the second biasing member 67, the valve body 65 moves to the open position. In addition, before the pressure in the pressure chamber 55 rises to the positive pressure due to the inflow of ink, the pressure receiving plate 69 is separated from the valve body 65 by the biasing force of the second biasing member 67, so that the pressure in the pressure chamber 55 is maintained in the range of negative pressure corresponding to the biasing force of the second biasing member 67.

As described above, the movement of the valve body 65 to the open position occurs due to the displacement of the movable wall 63. The outer surface side of the movable wall 63 is open to the atmosphere. Therefore, since the valve body 65 is moved to the open position by the differential pressure between the atmospheric pressure and the pressure chamber 55, the pressure regulating mechanism 60 of the liquid storage portion 50 is also referred to as a differential pressure valve mechanism (or self-sealing valve), and the autonomous pressure regulating function by the differential pressure valve mechanism is also referred to as a self-sealing function.

As described above, the liquid storage portion 50 can regulate the flow of the ink pressurized and supplied from the liquid supply source 18 to the liquid ejecting head 30, and the pressure of the ink on the downstream where the flow is regulated can be maintained within a predetermined negative pressure range.

That is, in the liquid storage portion 50, when the ink is ejected, the ink flows out from the supply flow path 51A and the pressure in the pressure chamber 55 is lower than a predetermined pressure less than the atmospheric pressure. The movable wall 63 that is displaced in the direction of reducing the volume of the pressure chamber 55 causes the valve body 65 to move to the open position. As a result, ink flows into the pressure chamber 55 from the inflow hole 68, and the pressure in the pressure chamber 55 rises. In addition, when the pressure in the pressure chamber 55 is equal to or higher than a predetermined pressure less than the atmospheric pressure due to the supply of ink, the valve body 65 again regulates the flow of ink from the upstream.

When an external force is applied to the liquid ejecting head 30, the impact may break the meniscus formed in the nozzle 31 and cause ink to leak from the nozzle 31. In order to suppress such ink leakage, the liquid storage portion 50 holds the inside of the pressure chamber 55 located upstream of the nozzle 31 at a predetermined negative pressure by the biasing force of the second biasing member 67.

Incidentally, the air passed through the films 56 and 57 may be dissolved in the liquid (ink), or the air may be dissolved in the liquid (ink) in the liquid supply path 27 through the supply tube 28. The dissolved air grows into minute air bubbles with the passage of time, and the air bubbles increase while further growing larger by combining the minute air bubbles. Since air bubbles of a certain size are lighter than the liquid, the air bubbles are likely to be accumulated in the upper part of the storage chamber 51 in which the liquid is stored and in the portion of the flow path communicating with the storage chamber 51 upstream of the storage chamber 51 on the storage chamber 51 side. The accumulated air bubbles may flow out to the liquid ejecting head 30 side due to an impact caused by an external force generated by a movement of the carriage 33 or a suction operation during maintenance. For example, when the liquid (ink) in the nozzle 31 or the common liquid chamber 32 contains air bubbles, the liquid cannot be ejected correctly from the nozzle 31 due to the air bubbles, and the frequency of ejection defects increases. Therefore, it is desired that this type of air bubbles be discharged from the storage chamber 51 by a discharge route different from that of the nozzle 31.

Therefore, the liquid ejecting apparatus 12 of the present embodiment is provided with the bubble discharge mechanism BS in order to discharge air bubbles accumulated at a position above the storage chamber 51 of the liquid storage portion 50. The bubble discharge mechanism BS is a mechanism that sucks and discharges air bubbles accumulated in the upper part of the storage chamber 51 by introducing negative pressure into the two discharge pipe portions 53 of the liquid storage portion 50.

Configuration of Bubble Discharge Mechanism

Next, the detailed configuration of the bubble discharge mechanism BS will be described with reference to FIGS. 9 to 12.

Figure 9:
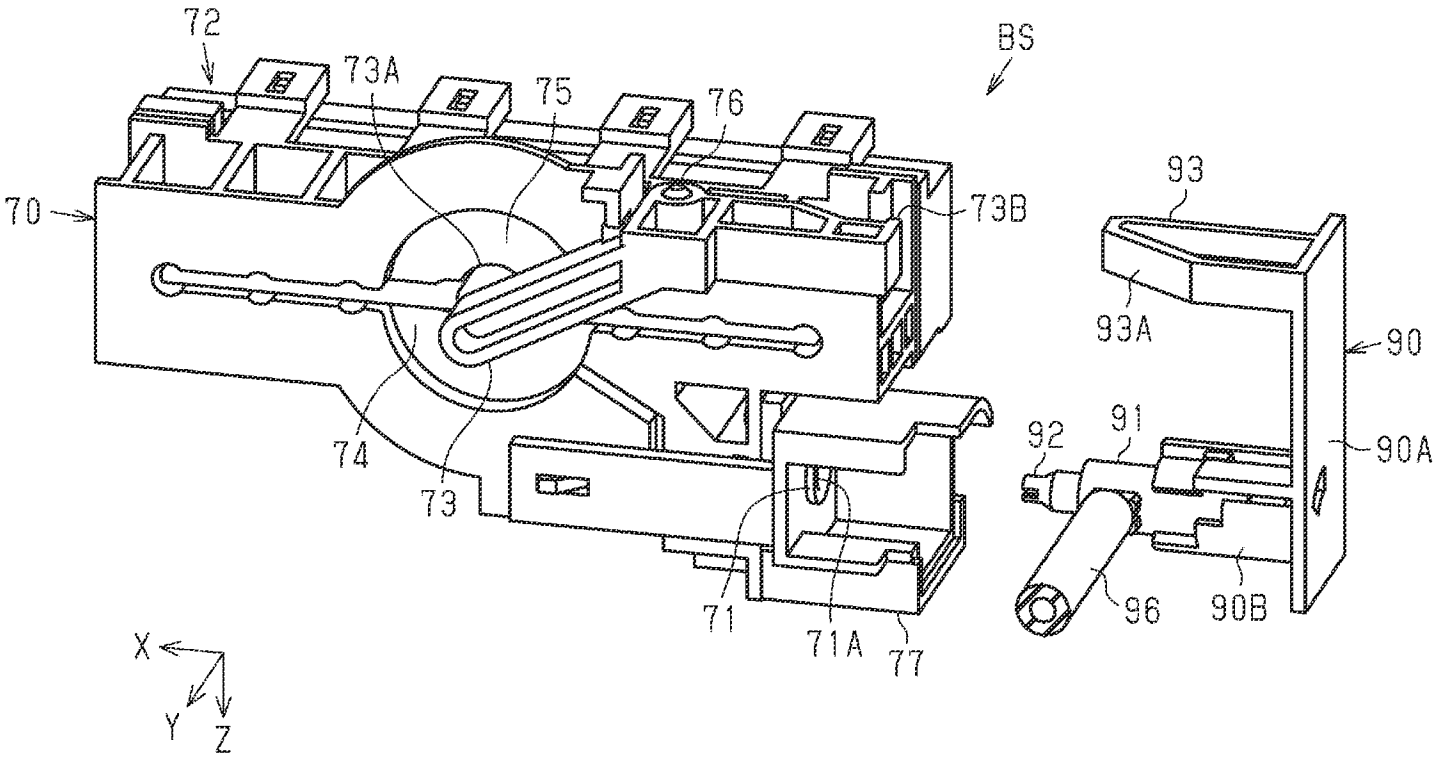
FIG. 9 is a perspective view illustrating a bubble discharge mechanism.

The bubble discharge mechanism BS illustrated in FIG. 9 includes the coupled portion 71 provided in the middle or at the end portion of the discharge flow path F capable of discharging the upper air in the storage chamber 51. The coupling portion 91 can be coupled to and separated from the coupled portion 71. Negative pressure acts on the coupling portion 91 by the negative pressure generating portion 97.

The bubble discharge mechanism BS illustrated in FIG. 9 is coupled to each discharge pipe portion 53 of the plurality of liquid storage portions 50 through a pipe line such as a tube (not illustrated) in a state where being mounted on the carriage 33 illustrated in FIG. 4. The bubble discharge mechanism BS is provided with a plurality of discharge flow paths F for discharging air bubbles by sucking a liquid containing air bubbles from each discharge pipe portion 53 by negative pressure, the air exhaust valve mechanism 70 having a plurality of opening/closing portions 81 and 82 (refer to FIG. 10) provided in the middle of the plurality of discharge flow paths F, respectively, and a coupling mechanism 90.

The air exhaust valve mechanism 70 is provided with the coupled portion 71 coupled to the coupling portion 91 on the negative pressure supply side in order to introduce negative pressure into the discharge flow path F. The coupling mechanism 90 is provided with the coupling portion 91 configured to be able to be coupled to the coupled portion 71. The air exhaust valve mechanism 70 includes a built-in multiple valve mechanism (refer to FIG. 10) including a plurality of opening/closing portions 81 and 82.

A first opening/closing portion 81 is configured to be able to open and close a first discharge flow path F1. The first opening/closing portion 81 opens and closes the first discharge flow path F1 in conjunction with the movement of the carriage 33. In addition, a second opening/closing portion 82 is configured to be able to open and close a second discharge flow path F2. The second opening/closing portion 82 opens and closes the second discharge flow path F2 in conjunction with the movement of the carriage 33. The first opening/closing portion 81 and the second opening/closing portion 82 open and close the first discharge flow path F1 and the second discharge flow path F2 in conjunction with the movement of the carriage 33.

Figure 10:
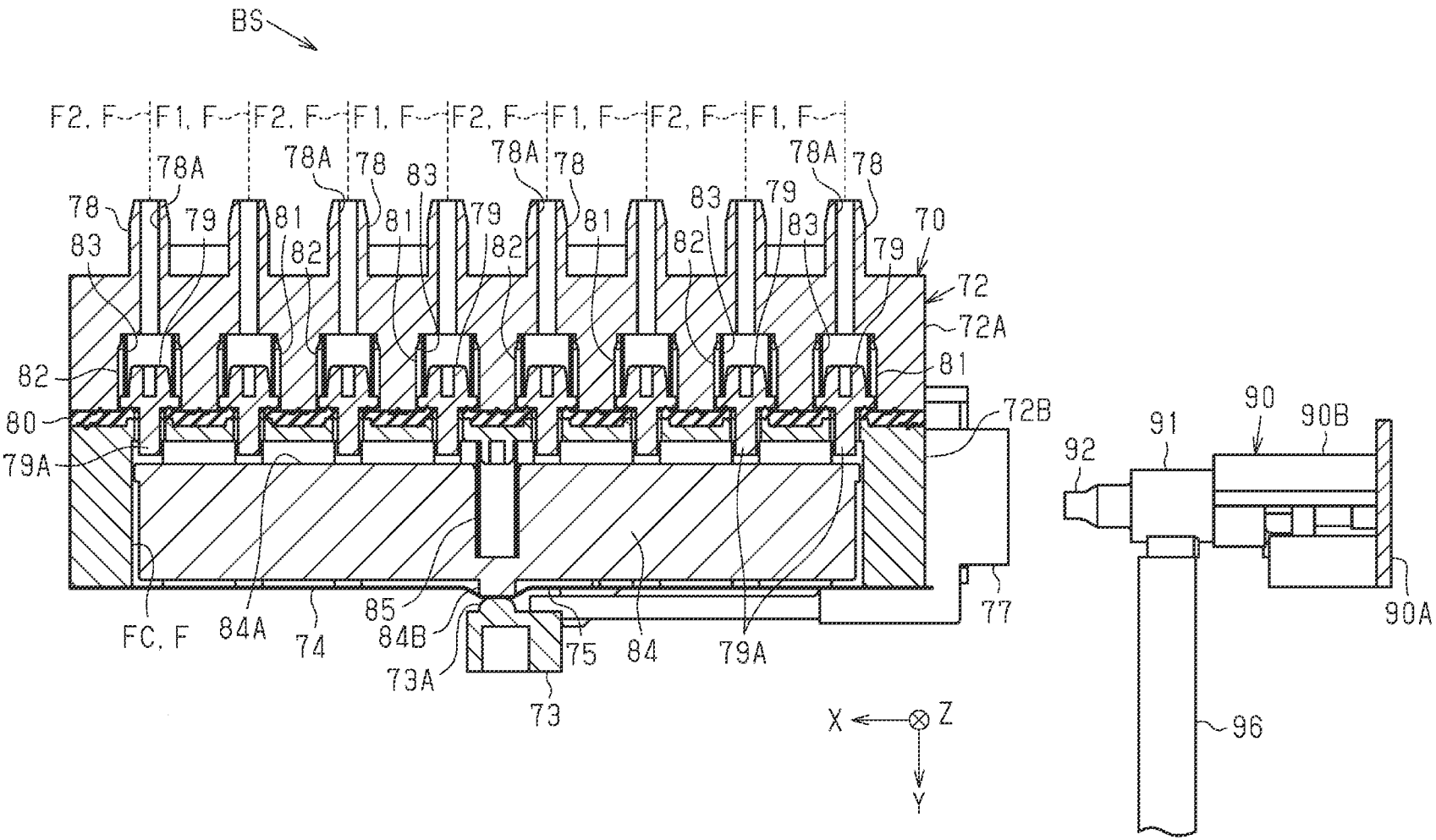
FIG. 10 is a plan sectional view illustrating the bubble discharge mechanism.

The air exhaust valve mechanism 70 is provided with a mechanism main body 72 having a built-in multiple valve mechanism, the coupled portion 71 fixed to one side portion of the mechanism main body 72 in the width direction parallel to the scanning direction X, and a lever 73 for driving the multiple valve mechanism. The air exhaust valve mechanism 70 is a pressed portion 75 in which the film 74 is partially exposed on one surface as the front surface of the mechanism main body 72. The pressed portion 75 is provided to drive the multiple valve mechanism housed in a merged discharge flow path FC formed inside the film 74 from the outside via the film 74. As illustrated in FIG. 10, a drive portion 73A at the tip end of the lever 73 presses a central portion of the circular pressed portion 75 to press and displace a pressing portion 84 housed therein. Therefore, the lever 73 is configured to open the multiple valve mechanism all at once.

The coupling mechanism 90 illustrated in FIGS. 9 and 10 is fixed to the inner surface of the housing 20 or a side frame (not illustrated) disposed along the inner surface. On the other hand, the air exhaust valve mechanism 70 is mounted on the carriage 33 together with the plurality of liquid storage portions 50. Therefore, the air exhaust valve mechanism 70 can move relative to the coupling mechanism 90 in the scanning direction X of the carriage 33.

As illustrated in FIG. 9, the lever 73 is rotatably provided about a rotation shaft 76 having a rotation axis parallel to the vertical direction Z. An engaged portion 73B that can be engaged with the guide member 93 of the coupling mechanism 90 is formed at an end portion of the lever 73 opposite to the drive portion 73A with the rotation shaft 76 interposed therebetween. The guide member 93 includes a guide surface 93A capable of engaging with the engaged portion 73B of the lever 73 and guiding the lever 73 so as to rotate by engaging with the engaged portion 73B. The engaged portion 73B of the lever 73 and the guide member 93 are located so as to face each other in the scanning direction X.

In addition, as illustrated in FIG. 9, the coupled portion 71 is provided with a coupled hole 71A having an axis parallel to the scanning direction X. On the other hand, a needle-shaped coupling nozzle 92 that can be inserted into the coupled hole 71A protrudes from the coupling portion 91 of the coupling mechanism 90 toward the +X side in the scanning direction X. The coupled hole 71A and the coupling nozzle 92 are located so as to face each other in the scanning direction X. A guide portion 77 that guides the coupling portion 91 so that the coupling portion 91 is coupled to the coupled portion 71 is provided. The coupling nozzle 92 may be provided so as to be slidable in the scanning direction X while being held by the holding portion 90B extending in the +X direction from a substrate 90A constituting the coupling mechanism 90.

Therefore, when the carriage 33 moves to a predetermined position in the scanning direction X, the coupled portion 71 and the coupling portion 91 are coupled to each other. That is, the coupling nozzle 92 of the coupling portion 91 is inserted into the coupled hole 71A of the coupled portion 71. In the coupling mechanism 90, the discharge tube 96 is coupled to a base portion of the coupling nozzle 92 in a direction intersecting the axis thereof. As illustrated in FIG. 2, the discharge tube 96 is coupled to the suction pump 45 via the switching valve 44. In the present embodiment, the negative pressure generating portion 97 that applies a negative pressure to the coupling portion 91 uses the suction pump 45 as a negative pressure drive source. That is, the negative pressure generating portion 97 uses the negative pressure drive source of the maintenance device 40 as a common negative pressure drive source.

Next, an internal configuration of the bubble discharge mechanism BS will be described with reference to FIG. 10.

As illustrated in FIG. 10, the air exhaust valve mechanism 70 includes a plurality of (for example, eight) introduction pipe portions 78. When assembled to the carriage 33, the plurality of introduction pipe portions 78 protrude in the −Y direction facing each liquid storage portion 50. The plurality of introduction pipe portions 78 are a portion of the discharge flow path F.

The air exhaust valve mechanism 70 includes a plurality of opening/closing portions 81 and 82 disposed in the middle of the plurality of discharge flow paths 78A. The opening/closing portions 81 and 82 are provided with a valve body 79 that can move in the Y direction, a rubber sheet 80, and a first spring 83 that biases the valve body 79 in a direction of pressing the valve body 79 against the rubber sheet 80. The valve body 79 includes a shaft portion 79A protruding in the +Y direction. The mechanism main body 72 of the air exhaust valve mechanism 70 includes a piping member 72A having a plurality of introduction pipe portions 78, a base member 72B assembled with the piping member 72A and the rubber sheet 80 interposed therebetween, and the film 74 that covers an opening portion in which a portion of the surface of the base member 72B on the +Y direction side is opened. By covering the opening of the base member 72B with the film 74, the merged discharge flow path FC is formed inside the base member 72B.

The liquid ejecting apparatus 12 is provided with the pressing portion 84 that can move the first opening/closing portion 81 in the opening and closing direction, and the lever 73 that moves the pressing portion 84 in conjunction with the movement of the carriage 33. The liquid ejecting apparatus 12 of the present example is provided with the first opening/closing portion 81 capable of opening and closing the first discharge flow path F1 and the second opening/closing portion 82 capable of opening and closing the second discharge flow path F2. The first opening/closing portion 81 and the second opening/closing portion 82 open and close the first discharge flow path F1 and the second discharge flow path F2 in conjunction with the movement of the carriage 33.

The discharge flow path F includes the merged discharge flow path FC formed by merging a plurality of first discharge flow paths F1 and a plurality of second discharge flow paths F2 corresponding to the plurality of liquid storage portions 50 in the middle.

The coupling portion 91 is coupled to the coupled portion 71 of the merged discharge flow path FC as the coupled portion 71 of the discharge flow path F.

The shaft portion 79A of the valve body 79 partially protrudes into the merged discharge flow path FC. One pressing portion 84 is housed in the merged discharge flow path FC in a state where the pressing portion 84 can be displaced in the Y direction. In addition, in the merged discharge flow path FC, a second spring 85 for biasing the pressing portion 84 in the same direction as the biasing direction where the valve body 79 is biased by the first spring 83 is disposed. One pressing portion 84 includes one surface facing all the shaft portions 79A of the plurality of valve bodies 79 as the pressing surface 84A.

One pressing portion 84 includes a projection portion 84B at the central portion of a surface facing the film 74. The lever 73 includes a drive portion 73A at the tip end portion, which includes a projection portion capable of pressing the projection portion 84B of the pressing portion 84 with the film 74 interposed therebetween.

When the lever 73 is in the retracted position, the pressing portion 84 is retracted in the −Y direction side, and the valve body 79 is pressed against the rubber sheet 80 by the biasing force of the first spring 83, so that the valve body 79 is closed. On the other hand, when the lever 73 rotates and pushes the pressing portion 84, the pressing portion 84 causes all the valve bodies 79 to be displaced on the open side against the biasing force of the first spring 83 by the pressing surface 84A. As a result, all the valve bodies 79 are opened. When all of these valve bodies are opened, the plurality of discharge flow paths F are merged at the merged discharge flow path FC.

In the present example, the plurality of discharge flow paths F corresponding to the plurality of liquid storage portions 50 merge in the middle to form the merged discharge flow path FC. That is, when the first opening/closing portion 81 and the second opening/closing portion 82 open, the plurality of discharge flow paths F merge at the merged discharge flow path FC. In particular, in the present embodiment, the coupling portion 91 is coupled to the coupled portion 71 of the merged discharge flow path FC as the coupled portion 71 of the plurality of discharge flow paths F.

The discharge flow path F includes the merged discharge flow path FC formed by merging a plurality of first discharge flow paths F1 and a plurality of second discharge flow paths F2 corresponding to the plurality of liquid storage portions 50 in the middle. The coupling portion 91 is coupled to the coupled portion 71 of the merged discharge flow path FC as the coupled portion 71 of the discharge flow path F. The rubber sheet 80 also serves as a sealing member for sealing a coupling portion between the piping member 72A and the base member 72B.

Next, a coupling structure between the coupling portion 91 and the coupled portion 71 will be described with reference to FIGS. 11 and 12.

An on-off valve V1 provided in the coupled portion 71 of the discharge flow path F and capable of opening and closing the discharge flow path F, and a third spring 88 as an example of the biasing portion that biases the on-off valve V1 in the direction of closing the coupled portion 71 of the discharge flow path F are provided. When the carriage 33 moves to a predetermined position, the coupling portion 91 is inserted into the discharge flow path F while pressing the on-off valve against the biasing force of the third spring 88. Therefore, the discharge flow path F is opened and the discharge flow path F and the coupling portion 91 communicate with each other.

Figure 11:
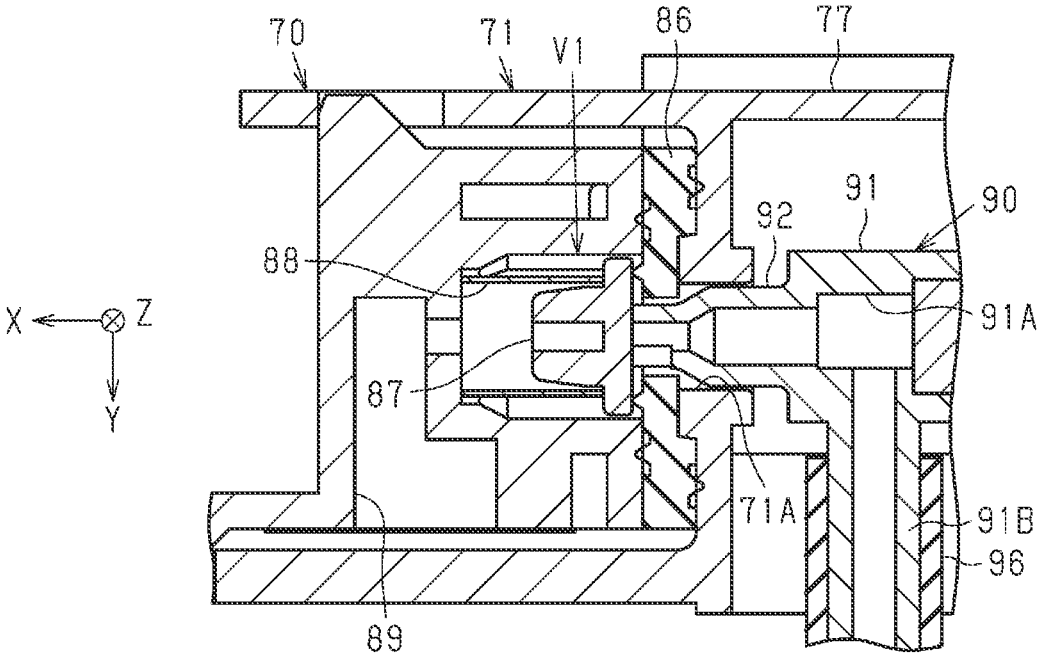
FIG. 11 is a cross-sectional view illustrating a non-coupling state of a coupled portion and a coupling portion in the bubble discharge mechanism.

As illustrated in FIG. 11, the coupled portion 71 includes the rubber sheet 86 inside the coupled hole 71A, the valve body 87, and the third spring 88 that biases the valve body 87 in the −X direction, where is a direction where the valve body 87 is pressed against the rubber sheet 86. At the stage where the coupling nozzle 92 is inserted up to the state illustrated in FIG. 11, the valve body 87 is pressed against the rubber sheet 86, so that the valve body 87 is closed. The coupling portion 91 includes a pipe portion 91B that communicates with the flow path 91A formed inside the coupling portion 91, and the end portion of the discharge tube 96 is coupled to the pipe portion 91B. In addition, a suction flow path 89 for communicating the merged discharge flow path FC and the coupling nozzle 92 is formed in the coupling portion 91 when the valve body 87 is in a valve opening position. The suction flow path 89 also forms a portion of the merged discharge flow path FC.

Figure 12:
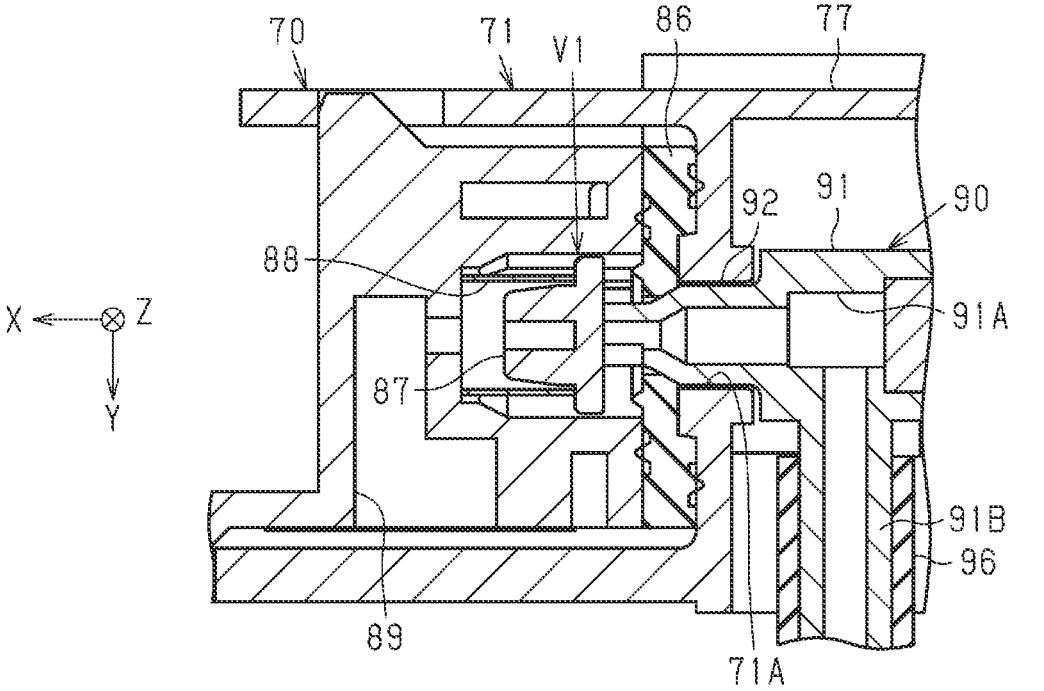
FIG. 12 is a cross-sectional view illustrating a coupling state of the coupled portion and the coupling portion of the bubble discharge mechanism.

As illustrated in FIG. 12, when the coupled portion 71 further moves in the −X direction together with the carriage 33, the coupling nozzle 92 is inserted deeper into the coupled hole 71A, and the valve body 87 is displaced in the +X direction against the biasing force of the third spring 88, so that the valve body 87 is opened. In this coupling state, the negative pressure from the discharge tube 96 is introduced into the merged discharge flow path FC through the coupling nozzle 92, a valve opening portion of the valve body 87, and the flow path 89. The discharge flow path F is configured to include the discharge flow path 59 and 61, a flow path such as a tube coupling between the discharge flow paths 59 and 61 and the discharge flow path 78A, the discharge flow path 78A, the merged discharge flow path, and the suction flow path 89. When there are the plurality of discharge flow paths F, the plurality of discharge flow paths F may merge as the merged discharge flow path FC in the middle as in the present embodiment or may not merge. In addition, the plurality of discharge flow paths F may include the first discharge flow path F1 for discharging the air above the storage chamber 51 and the second discharge flow path F2 for discharging the air above the filter chamber 54, or the plurality of discharge flow paths including only the first discharge flow path F1 or only the second discharge flow path F2 may be used.

Next, an operation of the liquid ejecting apparatus 12 will be described.

When a predetermined time for generating air bubbles elapses after performing the bubble discharge treatment, there is a bubble retention region BA in the upper part of the storage chamber 51 in the liquid storage portion 50, or a bubble retention region BA in the upper part of the filter chamber 54 and an upstream flow path located upstream of the filter FT, and air bubbles may grow and accumulate in these regions.

These bubble retention regions BA communicate with the discharge flow path F. Specifically, the bubble retention region BA in the upper part of the storage chamber 51 communicates with the first discharge flow path F1. In addition, the bubble retention region BA in the upper part of the filter chamber 54 or the upstream flow path communicates with the second discharge flow path F2. Normally, the first opening/closing portion 81 and the second opening/closing portion 82 are in a blocking state. In addition, since the coupled portion 71 and the coupling portion 91 are separated from each other, the on-off valve V1 is in a blocking state.

The liquid in the plurality of liquid storage portions 50 is in a negative pressure state. Therefore, since the first opening/closing portion and the second opening/closing portion are blocked, the pressure in the plurality of liquid storage portions 50 is maintained at a predetermined negative pressure.

When it is a predetermined time for discharging air bubbles, the control portion 100 switches the switching valve 44 from the first switching position for introducing the negative pressure from the suction pump 45 into the cap 41 and the second switching position for introducing the negative pressure from the suction pump 45 into the storage chamber 51 and the filter chamber 54 in the liquid storage portion 50 via the coupling between the coupling portion 91 and the coupled portion 71 of the bubble discharge mechanism BS. Next, the control portion 100 drives the negative pressure generating portion 97. That is, the control portion 100 drives the suction pump. As a result, a negative pressure is introduced into the coupling portion 91. The carriage motor 35 is driven to move the carriage 33 to the bubble discharge position P1. At this time, the discharge flow path F is opened stepwise in a predetermined order according to the movement of the carriage 33.

Figure 13:
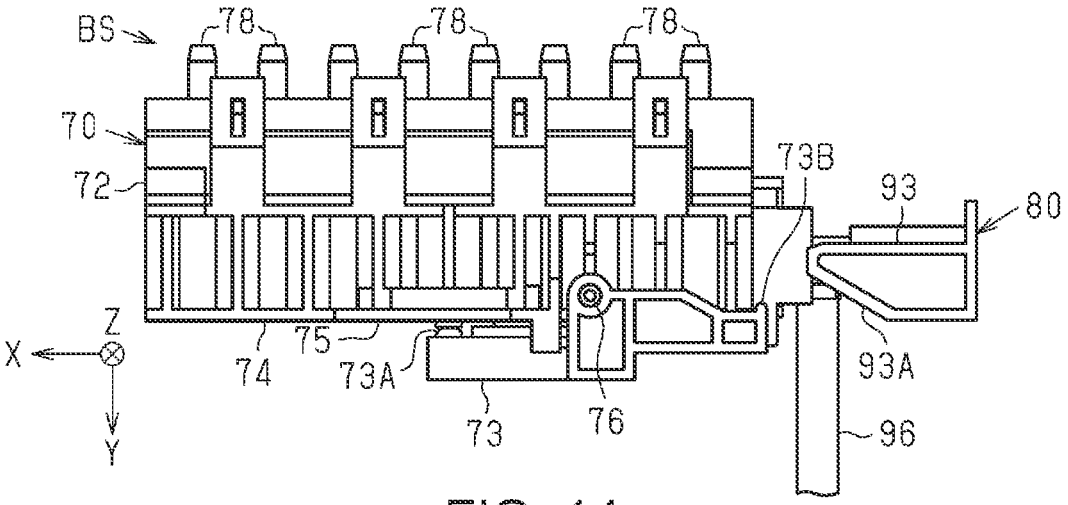
FIG. 13 is a plan view when the bubble discharge mechanism is in a non-coupling state.
Figure 16:
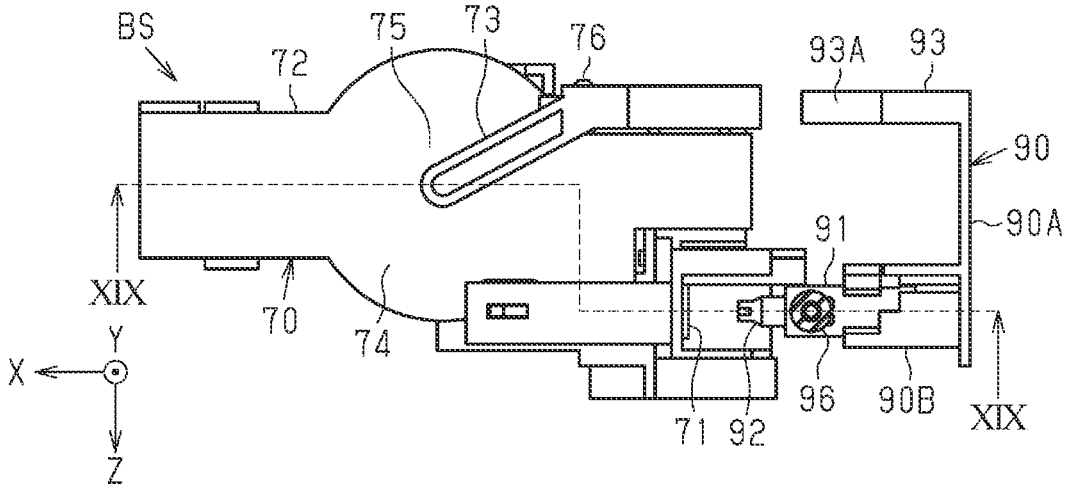
FIG. 16 is a front view when the bubble discharge mechanism is in the non-coupling state.
Figure 19:
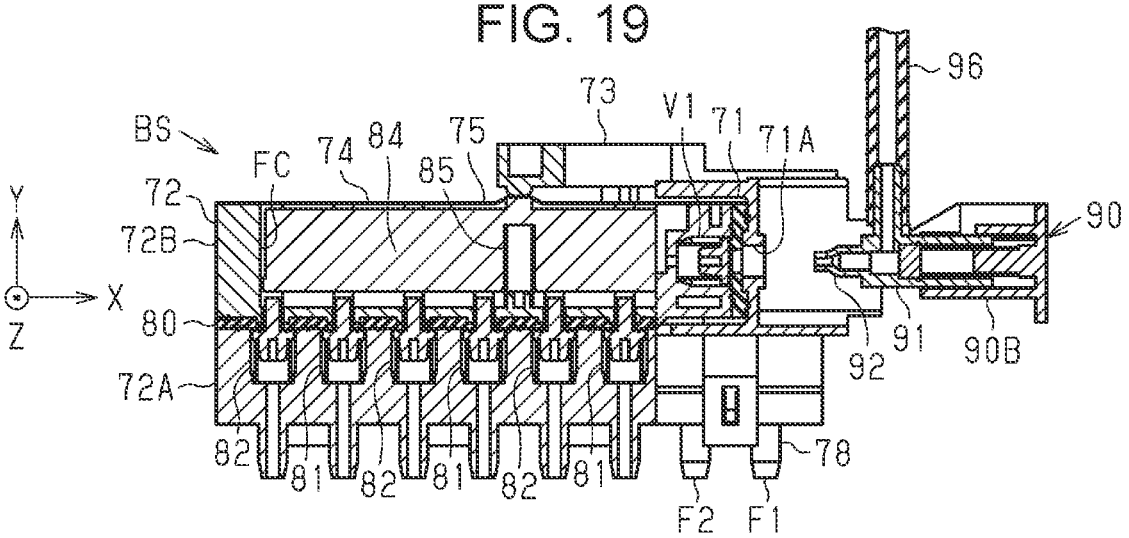
FIG. 19 is a bottom sectional view when the bubble discharge mechanism is in the non-coupling state.

Before the carriage 33 reaches the bubble discharge position P1, which is an example of a predetermined position, the coupling portion 91 is still separated from the coupled portion 71 as illustrated in FIGS. 13, 16, and 19.

Figure 14:
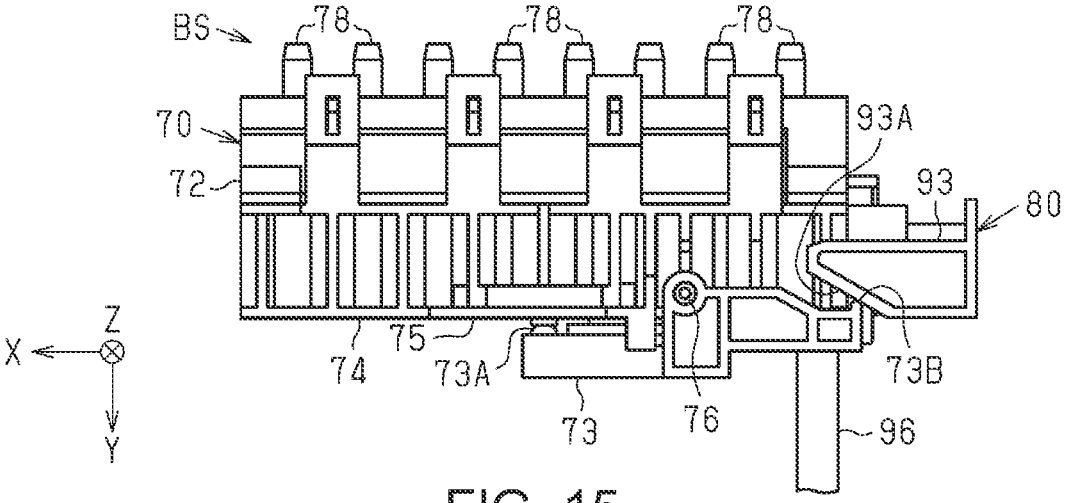
FIG. 14 is a plan view when the bubble discharge mechanism is in a first coupling state.
Figure 17:
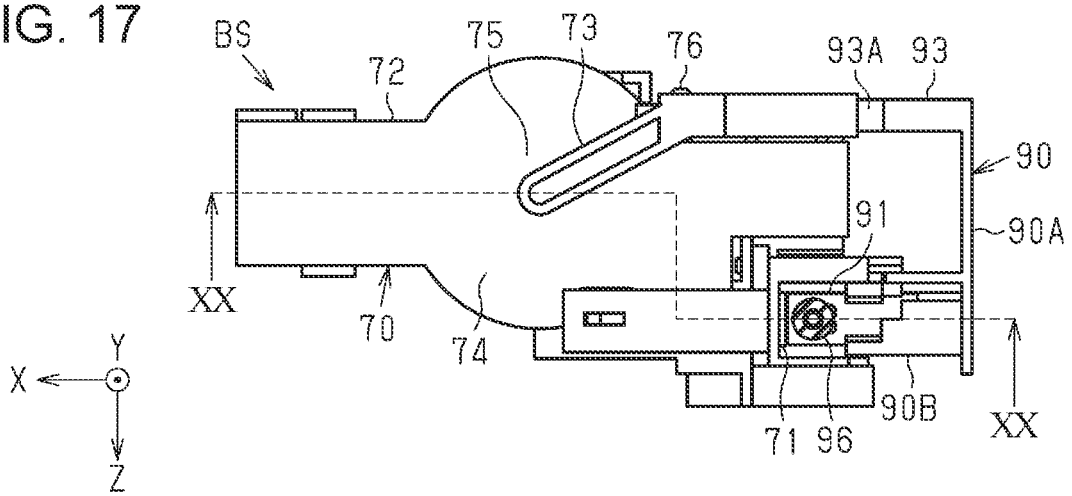
FIG. 17 is a front view when the bubble discharge mechanism is in the first coupling state.
Figure 20:
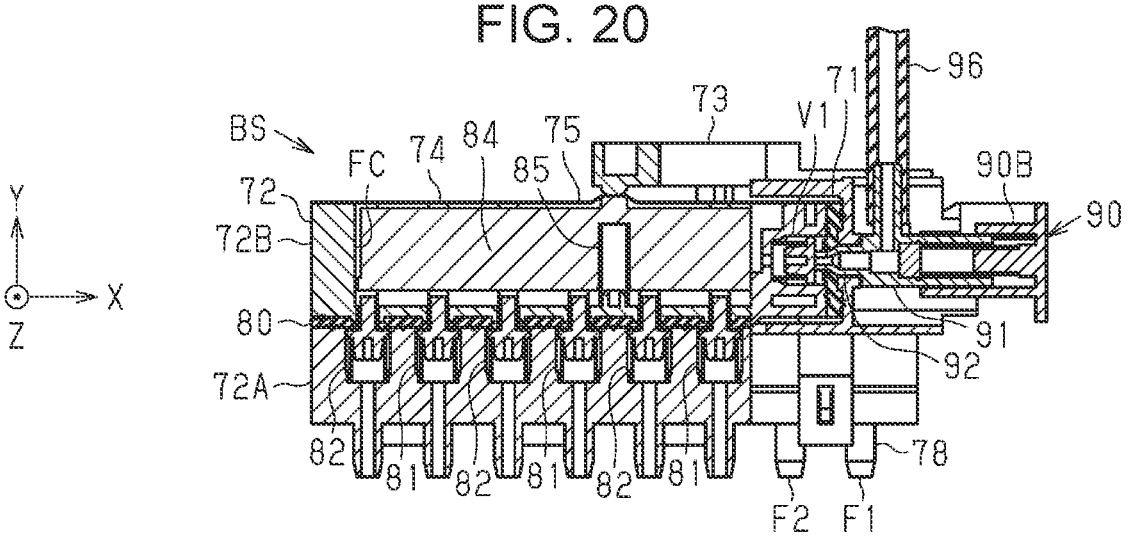
FIG. 20 is a bottom sectional view when the bubble discharge mechanism is in the first coupling state.

When the carriage 33 further approaches the bubble discharge position P1, as illustrated in FIGS. 14, 17, and 20, a first coupling state where the coupling portion 91 is coupled to the coupled portion 71 is established. Therefore, the on-off valve V1 is opened. As a result, a negative pressure is introduced into the merged discharge flow path FC. As a result, the merged discharge flow path FC, which is a region on the downstream in the bubble discharge direction with respect to the first opening/closing portion 81 and the second opening/closing portion 82, first is in a negative pressure state.

Figure 15:
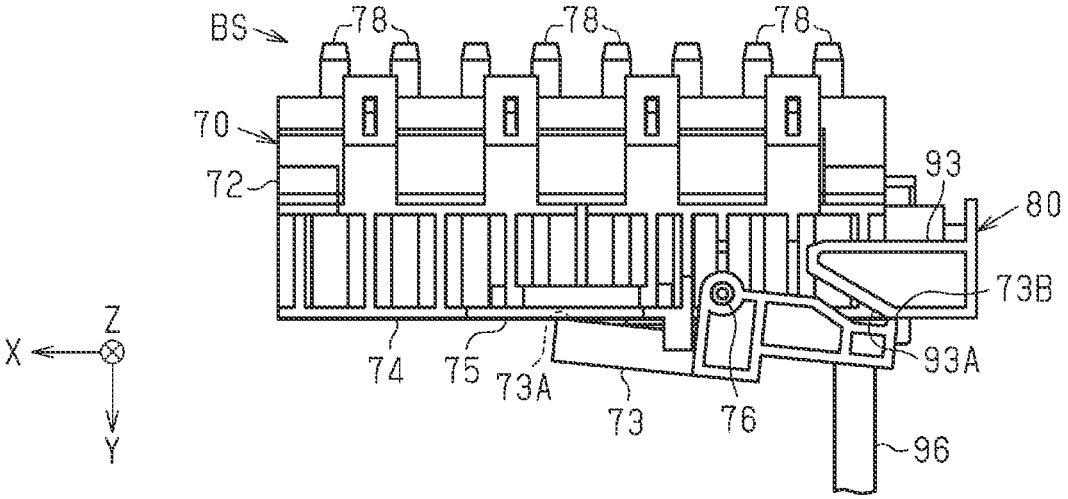
FIG. 15 is a plan view when the bubble discharge mechanism is in a second coupling state.
Figure 18:
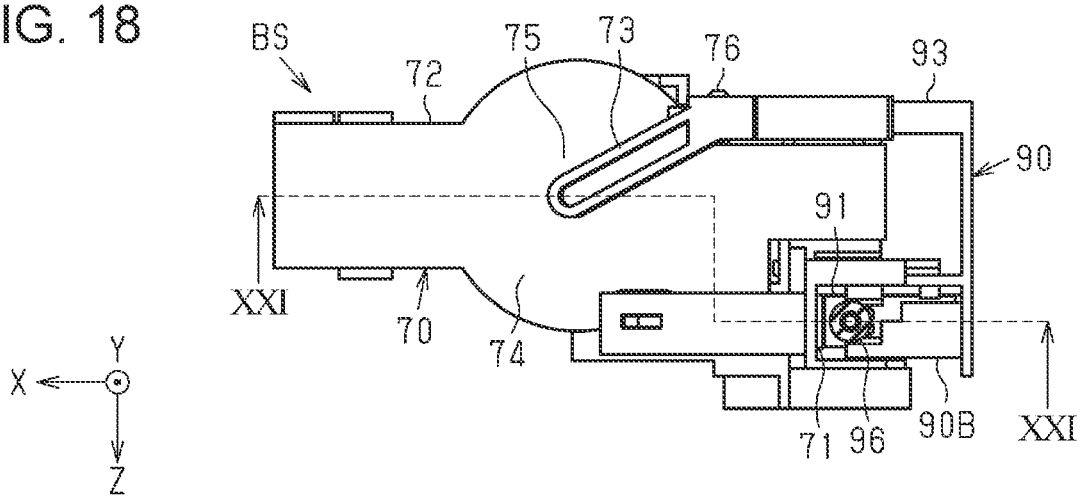
FIG. 18 is a front view when the bubble discharge mechanism is in the second coupling state.
Figure 21:
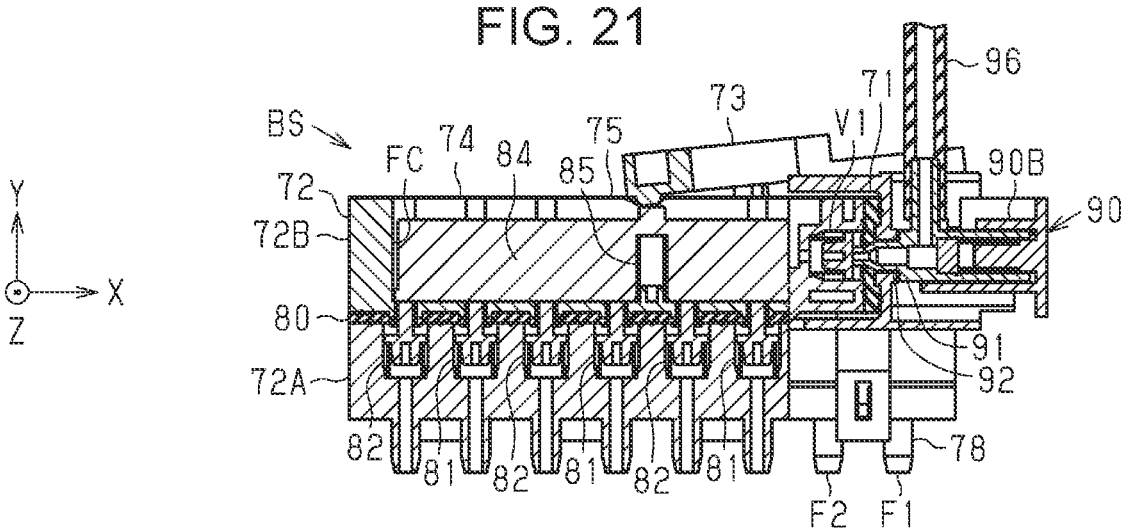
FIG. 21 is a bottom sectional view when the bubble discharge mechanism is in the second coupling state.

When the carriage 33 reaches the bubble discharge position P1 and the bubble discharge mechanism BS is in a second coupling state, as illustrated in FIGS. 15, 18, and 21, since the lever 73 pushes the pressing portion 84 in the direction of opening the first opening/closing portion 81 and the second opening/closing portion 82, both the opening/closing portions 81 and 82 are opened. As a result, a negative pressure is introduced into the upper part of the storage chamber 51 through the first discharge flow path F1, and a negative pressure is introduced into the upper part and the upstream flow path of the filter chamber 54 through the second discharge flow path F2. The air bubbles in the bubble retention region BA are sucked by the negative pressure, so that the air bubbles pass through the merged discharge flow path FC from the discharge flow paths F1 and F2, and are collected in the waste liquid housing portion 47 through the coupling portion between the coupled portion 71 and the coupling portion 91, and the discharge tube 96.

Here, when the opening/closing portions 81 and 82 and the on-off valve V1 are opened in the reverse order or at the same timing, since the merged discharge flow path FC is not yet in negative pressure when the opening/closing portions 81 and 82 are opened, there is a possibility that air normally flows back to the liquid storage portion 50 in the negative pressure state.

On the other hand, in the present embodiment, since the opening/closing portions 81 and 82 are opened after the merged discharge flow path FC is first put into a negative pressure state, the backflow of air can be avoided.

When the bubble discharge treatment for a predetermined time is completed, the carriage 33 is moved in a direction separated from the bubble discharge position P1 which is an example of the predetermined position. At this time, the opening/closing portions 81 and 82 are first blocked, and then the on-off valve V1 is blocked. Therefore, the negative pressure state in the liquid storage portion 50 is maintained.

First Control Method of Liquid Ejecting Apparatus

The liquid ejecting apparatus 12 of the present embodiment performs a following first control method.

By moving the carriage 33 to just before a predetermined position, the on-off valve V1 is opened at the coupling portion 91, and the coupling portion 91 is coupled to the coupled portion 71 of the discharge flow path F.

By moving the carriage 33 to a predetermined position, the lever 73 is moved in the direction of pressing the pressing portion 84 to open the first opening/closing portion 81.

By applying a negative pressure to the coupling portion 91 by the negative pressure generating portion 97, the air in the storage chamber 51 is sucked via the discharge flow path F.

Second Control Method of Liquid Ejecting Apparatus

The liquid ejecting apparatus 12 of the present embodiment performs a following second control method.

By moving the carriage 33 to just before a predetermined position, the on-off valve V1 is opened at the coupling portion 91, and the coupling portion 91 is coupled to the coupled portion 71 of the discharge flow path F.

By moving the carriage 33 to a predetermined position, the lever 73 is moved in the direction of pressing the pressing portion 84 to open the first opening/closing portion 81 and the second opening/closing portion 82.

By applying a negative pressure to the coupling portion 91 by the negative pressure generating portion 97, the air in the storage chamber 51 is sucked via the first discharge flow path F1 and at least one of the air in the upper part and the upstream flow path of the filter chamber 54 is sucked via the second discharge flow path F2.

Hereinbefore, as described above, according to the present embodiment, the following effects can be obtained.

1. The liquid ejecting apparatus 12 is provided with the liquid ejecting head 30 ejecting liquid from the nozzle 31, the liquid storage portion 50 having the storage chamber 51 configured to store the liquid supplied from the liquid supply source 18 to the liquid ejecting head 30, and the carriage 33 on which the liquid ejecting head 30 and the liquid storage portion 50 are mounted and configured to reciprocate in the scanning direction X. The liquid ejecting apparatus 12 is provided with the discharge flow path F configured to discharge air in the upper part of the storage chamber 51, the coupling portion 91 configured to be coupled to and separated from the coupled portion 71 of the discharge flow path F, and the negative pressure generating portion 97 that applies a negative pressure to the coupling portion 91. When the carriage 33 moves to a predetermined position, the coupling portion 91 is coupled to the coupled portion 71 of the discharge flow path F. Therefore, the coupled portion 71 of the discharge flow path F can be disposed at a position different from that of a position adjacent to the nozzle surface 30A, so that the bottom area of the carriage 33 is not increased. Therefore, it is possible to remove the air in the liquid storage portion 50 while suppressing the increase in the size of the liquid ejecting apparatus 12.

2. A plurality of liquid storage portions 50 are mounted on the carriage 33. A plurality of discharge flow paths F corresponding to the plurality of liquid storage portions 50 are merged in the middle to form a merged discharge flow path FC. The coupling portion 91 is coupled to the coupled portion 71 of the merged discharge flow path FC as the coupled portion 71 of the discharge flow path F. According to this configuration, since the discharge flow paths F are merged in the middle, the space for providing the discharge flow path F can be reduced, and the increase in the size of the printer can be suppressed.

3. The first opening/closing portion 81 configured to open and close the discharge flow path F is further provided. The first opening/closing portion 81 opens and closes the discharge flow path F in conjunction with the movement of the carriage 33. Therefore, since the discharge flow path F can be opened and closed only by moving the carriage 33, it is not necessary to separately provide a drive mechanism for opening and closing, and it is possible to suppress the increase in the size of the liquid ejecting apparatus 12.

4. The pressing portion 84 that can move in the direction of opening and closing the first opening/closing portion 81, and the lever 73 that moves the pressing portion 84 in conjunction with the movement of the carriage 33 are provided. Therefore, since the discharge flow path F can be opened and closed by a simple mechanism, it is possible to suppress the increase in the size of the liquid ejecting apparatus 12.

5. The liquid ejecting apparatus 12 is provided with the liquid ejecting head 30 that ejects liquid from the nozzle 31, the liquid storage portion 50 having the storage chamber 51 configured to store the liquid supplied from the liquid supply source 18 to the liquid ejecting head 30, and the carriage 33 on which the liquid ejecting head 30 and the liquid storage portion 50 are mounted and configured to reciprocate in the scanning direction X. The liquid ejecting apparatus 12 is provided with the filter FT provided upstream of the storage chamber 51 in the liquid storage portion 50 and that filters the liquid supplied from the liquid supply source 18, and the discharge flow path F that includes the first discharge flow path F1 configured to discharge air in the upper part of the storage chamber 51 and the second discharge flow path F2 configured to discharge air in at least one of the upper part of the filter chamber 54 in which the filter FT is housed in the liquid storage portion 50 and the upstream flow path located upstream in the liquid supply direction from the filter FT in the liquid storage portion 50. Furthermore, the liquid ejecting apparatus 12 is provided with the coupling portion 91 configured to be coupled to and separated from the coupled portion 71 of the discharge flow path F, and the negative pressure generating portion 97 that applies a negative pressure to the coupling portion 91. When the carriage 33 moves to a predetermined position, the coupling portion 91 is coupled to the coupled portion 71 of the discharge flow path F. Therefore, since the coupled portion 71 of the discharge flow path F is provided at a position different from the nozzle surface 30A, the bottom area of the carriage 33 does not increase. Therefore, it is possible to remove the air in the liquid storage portion 50 while suppressing the increase in the size of the liquid ejecting apparatus 12.

6. A plurality of liquid storage portions are mounted on the carriage 33, and a plurality of first discharge flow paths F1 and a plurality of second discharge flow paths F2 corresponding to the plurality of liquid storage portions are merged in a middle to form a merged discharge flow path. The coupling portion 91 is coupled to the coupled portion 71 of the merged discharge flow path FC as the coupled portion 71 of the discharge flow path F. Therefore, since the discharge flow paths F are merged in the middle, the space for providing the discharge flow path F can be reduced, and the increase in the size of the liquid ejecting apparatus 12 can be further suppressed.

7. The first opening/closing portion 81 configured to open and close the first discharge flow path F1 and the second opening/closing portion 82 configured to open and close the second discharge flow path F2 are further provided. The first opening/closing portion 81 and the second opening/closing portion 82 open and close the first discharge flow path F1 and the second discharge flow path F2 in conjunction with the movement of the carriage 33. Therefore, since the discharge flow path can be opened and closed only by moving the carriage 33, it is not necessary to separately provide a drive mechanism for opening and closing, and it is possible to suppress the increase in the size of the liquid ejecting apparatus 12.

8. The pressing portion 84 configured to move in the direction of opening and closing the first opening/closing portion 81 and the second opening/closing portion 82, and the lever 73 that moves the pressing portion 84 in conjunction with the movement of the carriage 33 are provided. Therefore, since the discharge flow path F can be opened and closed by a simple mechanism, it is possible to suppress the increase in the size of the liquid ejecting apparatus 12.

9. The coupling portion 91 extends in the scanning direction X at a predetermined position. The coupled portion 71 of the discharge flow path F is open to a position facing the coupling portion 91 in the scanning direction X. Therefore, the discharge flow path F and the coupling portion 91 can be easily coupled to each other.

10. The liquid ejecting apparatus 12 is provided with the on-off valve V1 provided at the coupled portion 71 of the discharge flow path F and configured to open and close the discharge flow path F, and the biasing portion that biases the on-off valve in a direction of closing the coupled portion 71 of the discharge flow path F. When the carriage 33 moves to the predetermined position, the coupling portion 91 is inserted into the discharge flow path F while pressing the on-off valve against the biasing force of the biasing portion, and thus the discharge flow path F is opened and the discharge flow path F and the coupling portion 91 communicate with each other. Therefore, since the discharge flow path F can be closed when not coupled, ink dripping and water evaporation from the liquid storage portion 50 can be suppressed.

11. The liquid ejecting apparatus 12 further includes the cap 41 configured to form a closed space to which the nozzle 31 is open. The negative pressure generating portion 97 communicates with the cap 41. Therefore, since the negative pressure generating portion 97 can also be used for suction cleaning, it is not necessary to separately provide a suction mechanism, and it is possible to suppress the increase in the size of the liquid ejecting apparatus 12.

12. The liquid ejecting apparatus 12 is provided with the liquid ejecting head 30 that ejects liquid from the nozzle 31, the liquid storage portion 50 having the storage chamber 51 configured to store the liquid supplied from the liquid supply source 18 to the liquid ejecting head 30, and the carriage 33 on which the liquid ejecting head 30 and the liquid storage portion 50 are mounted and configured to reciprocate in the scanning direction X. Furthermore, the liquid ejecting apparatus 12 is provided with the discharge flow path F configured to discharge air in an upper part of the storage chamber 51, the first opening/closing portion 81 configured to open and close the discharge flow path F, the pressing portion 84 configured to move in a direction of opening and closing the first opening/closing portion 81, the lever 73 moving the pressing portion 84 in conjunction with the movement of the carriage 33. In addition, the liquid ejecting apparatus 12 is provided in the on-off valve V1 provided at the coupled portion 71 of the discharge flow path F and configured to open and close the discharge flow path F, the coupling portion 91 configured to be coupled to and separated from the coupled portion 71 of the discharge flow path F, and the negative pressure generating portion 97 applying a negative pressure to the coupling portion 91. A control method of the liquid ejecting apparatus 12 includes opening the on-off valve at the coupling portion 91, and coupling the coupling portion 91 to the coupled portion 71 of the discharge flow path F by moving the carriage 33 to a front of a predetermined position, moving the lever 73 in a direction of pressing the pressing portion 84 to open the first opening/closing portion by moving the carriage 33 to the predetermined position, and sucking the air in the storage chamber 51 via the discharge flow path F by applying a negative pressure to the coupling portion 91 by the negative pressure generating portion 97. According to this method, the air in the liquid storage portion 50 can be removed, and the backflow of air to the storage chamber 51 can be suppressed in the process of removing the air.

13. The liquid ejecting apparatus 12 is provided with the liquid ejecting head 30 that ejects liquid from the nozzle 31, the liquid storage portion 50 having the storage chamber 51 configured to store the liquid supplied from the liquid supply source 18 to the liquid ejecting head 30, and the carriage 33 on which the liquid ejecting head 30 and the liquid storage portion 50 are mounted and configured to reciprocate in the scanning direction X. Furthermore, the liquid ejecting apparatus 12 is provided with the filter FT provided upstream of the storage chamber 51 in the liquid storage portion 50 and that filters the liquid supplied from the liquid supply source 18, and the discharge flow path F that includes the first discharge flow path F1 configured to discharge air in the upper part of the storage chamber 51 and the second discharge flow path F2 configured to discharge air in at least one of the upper part of the filter chamber 54 in which the filter FT is housed in the liquid storage portion 50 and the upstream flow path located upstream in the liquid supply direction from the filter FT in the liquid storage portion 50. In addition, the liquid ejecting apparatus 12 is provided with the coupling portion 91 configured to be coupled to and separated from the coupled portion 71 of the discharge flow path F, and the negative pressure generating portion 97 that applies a negative pressure to the coupling portion 91. A control method of the liquid ejecting apparatus 12 includes coupling the coupling portion 91 to the coupled portion 71 of the discharge flow path F by moving the carriage 33 to a predetermined position, and sucking the air in the storage chamber 51 via the first discharge flow path F1, and sucking the air in at least one of the upper part of the filter chamber 54 and the upstream flow path via the second discharge flow path F2 by applying a negative pressure to the coupling portion 91 by the negative pressure generating portion 97. According to this method, the air in the liquid storage portion 50 can be removed.

The above embodiment can also be changed to an aspect such as modification examples illustrated below. Furthermore, a further modification example may be a combination of the above embodiment and the modification examples illustrated below, or a combination of the modification examples illustrated below may be a further modification example.

Although the number of pressing portions 84 is one, a plurality of pressing portions 84 may be provided. For example, the liquid storage portion 50 includes a first storage chamber and a second storage chamber, and is provided with a first discharge flow path for discharging air in the upper part of a plurality of first storage chambers and a second discharge flow path for discharging air in the upper part of a plurality of second storage chambers. The first opening/closing portion includes one first opening/closing portion configured to open and close a plurality of first discharge flow paths and the other first opening/closing portion configured to open and close a plurality of second discharge flow paths. A configuration may be adopted in which the pressing portion includes a first pressing portion that can move in the direction of opening and closing one first opening/closing portion and a second pressing portion that can move in the direction of opening and closing the other first opening/closing portion. For example, a configuration is adopted in which one first opening/closing portion configured to open and close the first discharge flow path for discharging the air in the upper part of the filter chamber as the first storage chamber, and the other first opening/closing portion configured to open and close the second discharge flow path for discharging the air in the upper part of the pressure chamber as the second storage chamber are provided. One first pressing portion that can move in the direction of opening and closing one of the plurality of first opening/closing portions and one second pressing portion that can move in the direction of opening and closing the other of the plurality of first opening/closing portions are separately provided. A configuration may be adopted in which a lever that moves the first pressing portion in conjunction with the movement of the carriage and a lever that moves the second pressing portion in conjunction with the movement of the carriage are provided. In this case, the lever may be a first lever and a second lever which are separately provided and move the first pressing portion and the second pressing portion separately, or may be a common lever that moves the first pressing portion and the second pressing portion with one lever.

The liquid storage portion may be a damper. The damper mounted on the carriage 33 includes a storage chamber for storing the liquid and a diaphragm forming a portion of a wall surface of the storage chamber. The damper absorbs the pressure fluctuation of the liquid generated when the carriage 33 moves by deforming the diaphragm. That is, the damper temporarily stores the liquid supplied from the liquid supply source 18 via the supply tube 28, and supplies the liquid to the ejecting head 30 via the second supply path 27*b* while alleviating the pressure fluctuation generated when the carriage 33 reciprocates. The bubble discharge mechanism BS is provided with a coupled portion of the discharge flow path that communicates with the upper part of the storage chamber of the damper, the coupling portion 91 configured to be coupled to and separated from the coupled portion of the discharge flow path, and the negative pressure generating portion 97 that applies a negative pressure to the coupling portion 91. The bubble discharge mechanism BS is configured so that the coupled portion 71 and the coupling portion 91 can be coupled to each other when the carriage 33 is at a predetermined position in the scanning direction X. With this configuration, even when the liquid ejecting apparatus 12 is provided with a configuration for discharging the air in the upper part of the storage chamber 51 of the liquid storage portion 50, it is possible to suppress the increase in the size of the liquid ejecting apparatus 12.

In the above embodiment, the liquid storage portion 50 is provided with the storage chamber 51 and the filter chamber 54, and may be a liquid storage portion 50 having a storage chamber 51 but not a filter chamber 54. In this case, the filter FT may be provided as a separate member from the liquid storage portion 50. Even with this configuration, a configuration for removing air in the upper part of the storage chamber 51 can be provided in the liquid ejecting apparatus 12 while suppressing the increase in the size of the liquid ejecting apparatus 12.

A configuration may be adopted in which each of downstream ends of a plurality of discharge flow paths has a coupled portion, and a plurality of coupling portions individually coupled to each of a plurality of coupled portions are provided.

In the above embodiment, the plurality of discharge flow paths are provided, and the number of discharge flow paths may be one.

The negative pressure drive source of the negative pressure generating portion 97 is not limited to a configuration in which the suction pump 45, which is the negative pressure drive source of the maintenance device 40, is diverted, and a dedicated suction pump may be provided. In this case, the cleaning performed by the maintenance device is not limited to suction cleaning. That is, the maintenance device may perform pressure cleaning for forcibly discharging the liquid from the nozzle 31 by pressurizing the liquid on the upstream of the nozzle 31.

Only one discharge flow path F may be provided. In this case, a coupled portion may be provided in one discharge flow path.

A configuration may be adopted in which only the air bubbles in the upper part of the storage chamber 51 are discharged, and the air bubbles in the upper part of the filter chamber and the air bubbles in the upstream flow path are not discharged.

Only one of the opening/closing portion 81 and the on-off valve V1 may be provided.

A configuration may be adopted in which a plurality of discharge flow paths F1 for discharging air bubbles in the upper part of the storage chamber 51 and a plurality of discharge flow paths F2 for discharging air bubbles in the upper part of the filter chamber 54 are separately merged to provide two merged discharge flow paths. In this case, the coupled portion and the coupling portion may be provided for each merged discharge flow path.

A plurality of liquid storage portions 50 are divided into two or more N liquid storage portions 50 and M liquid storage portions 50, respectively, and merged discharge flow paths may be provided for each group of liquid storage portions divided into N and M. N discharge flow paths F1 for discharging air bubbles in the upper part of the storage chamber 51 of the N liquid storage portions 50 and N discharge flow paths F2 for discharging air bubbles in the upper part of the filter chamber 54 of the N liquid storage portions 50 are merged to form one merged discharge flow path FC1. In addition, M discharge flow paths F1 for discharging air bubbles in the upper part of the storage chamber 51 of the M liquid storage portions 50 and M discharge flow paths F2 for discharging air bubbles in the upper part of the filter chamber 54 of the M liquid storage portions 50 are merged to form one merged discharge flow path FC2. A coupled portion may be provided in each of the two merged discharge flow paths FC1 and FC2, and two corresponding coupling portions may be coupled to these two coupled portions according to the movement of the carriage 33.

The number of merged discharge flow paths is not limited to one or two, and may be three or more.

A plurality of discharge flow paths may not be merged. For example, an opening/closing portion may be provided individually for each of the plurality of discharge flow paths. A coupled portion that can be coupled to the coupling portion may be provided for each of the plurality of discharge flow paths.

The liquid supply source 18 may have a configuration configured to contain a liquid, and may be, for example, a replaceable cartridge type. In this case, an on-carriage type in which the ink cartridge is mounted on the carriage 33 may be used, or an off-carriage type in which the ink cartridge is mounted on a holder on the housing 20 side may be used. In addition, the liquid supply source 18 may be a tank type mounted on the carriage 33 and configured to replenish the liquid.

The liquid storage portion 50 may be configured not to include a filter FT.

The liquid ejecting apparatus 12 may be a liquid ejecting apparatus that ejects a liquid other than ink. The state of the liquid ejected as a minute amount of droplets from the liquid ejecting apparatus includes a liquid having a granular, lacrimal, or filamentous tail. In addition, the liquid referred to here may be any material that can be ejected from the liquid ejecting apparatus. For example, the liquid may be in a state when the substance is in the liquid phase, and include fluids such as highly viscous or low viscous liquids, sol, gel water, other inorganic solvents, organic solvents, solutions, liquid resins, liquid metals (metal melts), and the like. In addition, the liquid includes not only a liquid as a state of a substance but also a liquid in which particles of a functional material made of a solid substance such as a pigment or a metal particle are dissolved, dispersed or mixed in a solvent. Typical examples of the liquid include ink, liquid crystal, and the like as described in the above-described embodiment. Here, the ink includes general water-based inks, oil-based inks, and various liquid compositions such as gel inks and hot melt inks. As a specific example of the liquid ejecting apparatus, for example, there is a liquid ejecting apparatus that ejects a liquid containing a material such as an electrode material or a coloring material used for manufacturing a liquid crystal display, an electroluminescence (EL) display, a surface emitting display, a color filter, and the like in a dispersed or dissolved form. In addition, a liquid ejecting apparatus that ejects a bioorganic substance used for manufacturing a biochip, a liquid ejecting apparatus that ejects a liquid as a sample used as a precision pipette, a printing device, a micro dispenser, and the like may be used. Furthermore, a liquid ejecting apparatus that pinpointly ejects lubricating oil to precision machinery such as watches and cameras, a liquid ejecting apparatus that ejects a transparent resin liquid such as an ultraviolet curable resin onto a substrate to form a micro hemispherical lens (an optical lens), and the like used for an optical communication element or the like may be used. In addition, a liquid ejecting apparatus that ejects an etching solution such as an acid or an alkali in order to etch a substrate or the like may be used.

Hereinafter, the present disclosure will be described based on a second embodiment. In each figure, the same members are designated by the same reference numerals, and redundant description will be omitted.

In addition, in each figure, X, Y, and Z represent three spatial axes that are orthogonal to each other. In the present specification, the directions along these axes are the X axis direction, the Y axis direction, and the Z axis direction. When the direction is specified, the positive direction is a "+" and the negative direction is "−", and using positive and negative signs in the direction notation, the direction where the arrows in each figure are directed is described as + direction and the direction opposite to the arrows is described as − direction. In addition, the Z axis direction illustrates a vertical direction, the +Z direction illustrates a vertical downward direction, and the −Z direction illustrates a vertical upward direction. Furthermore, the three X, Y, and Z spatial axes that do not limit the positive direction and the negative direction will be described as the X axis, the Y axis, and the Z axis.

Second Embodiment

In the present embodiment, a liquid ejecting apparatus 1100 is configured as an ink jet printer, and ejects ink onto the printing paper P to form an image. Ink is an example of a fluid and an example of a liquid. Instead of the printing paper P, any type of medium such as a resin film or a cloth may be used as the ink ejection target.

Figure 22:
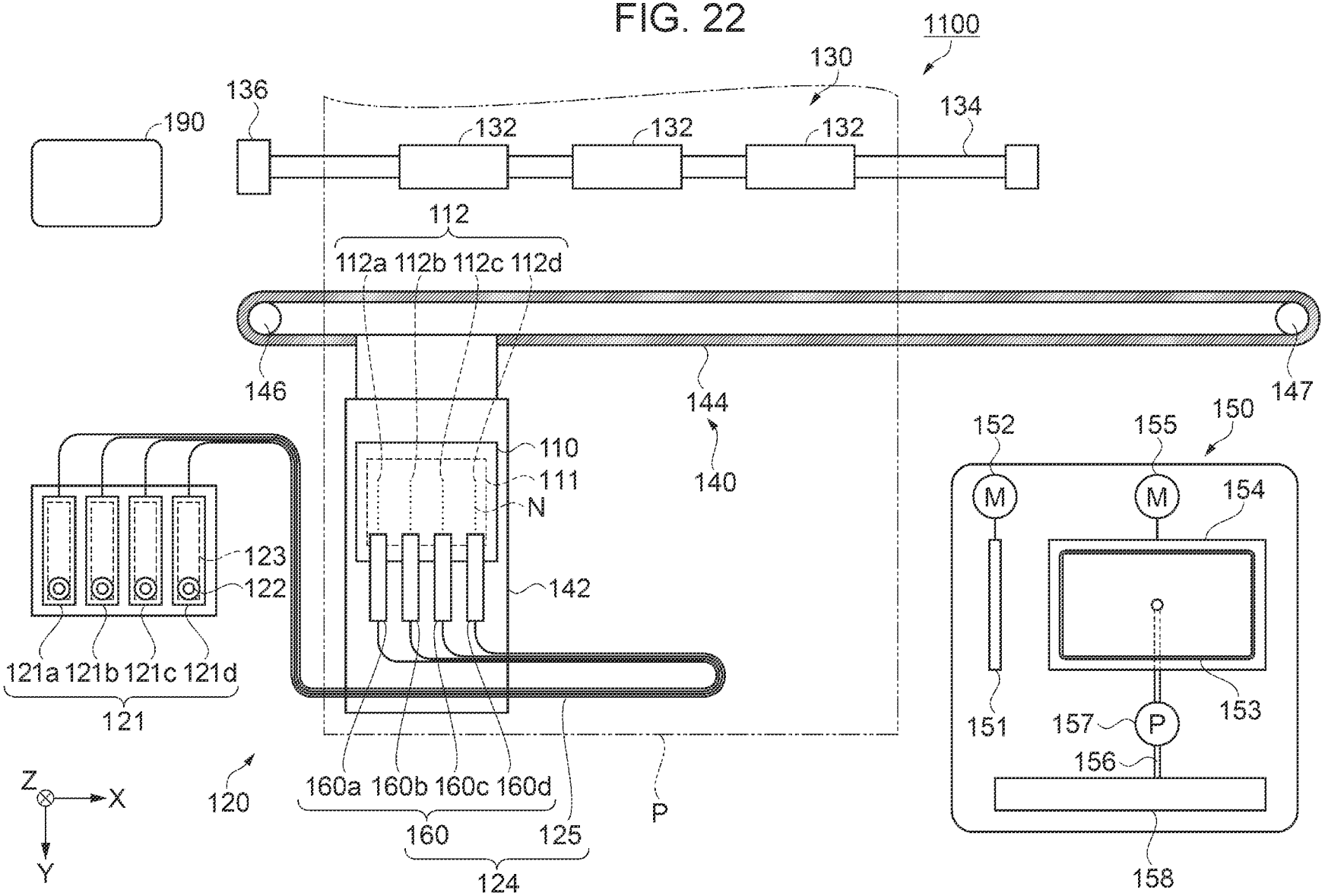
FIG. 22 is a block diagram illustrating a schematic configuration of a liquid ejecting apparatus including a liquid ejecting head as a second embodiment of the present disclosure.

As illustrated in FIG. 22, the liquid ejecting apparatus 1100 is provided with a liquid ejecting head 110, an ink supply portion 120, a transport mechanism 130, a moving mechanism 140, a maintenance portion 150, and a control portion 190.

The liquid ejecting head 110 includes a nozzle surface 111 provided with a plurality of nozzle rows 112 for ejecting ink. The nozzle row 112 is formed by arranging a plurality of nozzles N in the Y axis direction. The liquid ejecting head 110 ejects ink in the +Z direction from the plurality of nozzles N constituting the nozzle row 112 to form an image on the printing paper P. In the present embodiment, the plurality of nozzle rows 112 includes a nozzle row 112*a*, a nozzle row 112*b*, a nozzle row 112*c*, and a nozzle row 112*d*.

As the ink to be ejected, for example, the ink of four colors in total of black, cyan, magenta, and yellow is used, and each ink may be ejected from a nozzle row 112*a*, a nozzle row 112*b*, a nozzle row 112*c*, and a nozzle row 112*d*. In addition to the above four colors, ink of any color such as light cyan, light magenta, and white may be ejected. The liquid ejecting head 110 is mounted on a carriage 142 included in the moving mechanism 140, which will be described later, and reciprocates in the main scanning direction as the carriage 142 moves. In the present embodiment, the main scanning directions are the +X direction and the −X direction.

The ink supply portion 120 supplies ink to the liquid ejecting head 110. The ink supply portion 120 is provided with a liquid supply source 121 and a supply flow path 124. The liquid supply source 121 of the present embodiment is a replenishment type tank including a filling portion 122 capable of filling ink and a housing chamber 123 containing ink filled from the filling portion 122, and may be a replaceable cartridge type tank. The ink supply portion 120 is provided with a plurality of liquid supply sources 121. In the present embodiment, the plurality of liquid supply sources 121 include a liquid supply source 121*a* containing black ink, a liquid supply source 121*b* containing cyan ink, a liquid supply source 121*c* containing magenta ink, and a liquid supply source 121*d* containing yellow ink.

The supply flow path 124 couples the liquid supply source 121 and the liquid ejecting head 110, so that the ink contained in the liquid supply source 121 flows toward the liquid ejecting head 110. The supply flow path 124 of the present embodiment includes a valve unit 160 provided on the carriage 142 and coupled to the liquid ejecting head 110, and a tube 125 coupling the liquid supply source 121 and the valve unit 160.

The valve unit 160 regulates the pressure of the ink supplied to the liquid ejecting head 110 to a predetermined negative pressure. Therefore, in the present embodiment, restrictions on the position of the liquid supply source 121 in the Z axis direction are reduced. For example, the liquid supply source 121 can be disposed at a position where the liquid level of the ink in the liquid supply source 121 is in the −Z direction of the nozzle surface 111 of the liquid ejecting head 110. A plurality of valve units 160 are provided in the supply flow path 124. In the present embodiment, the plurality of valve units 160 include a valve unit 160*a* in which the ink from the liquid supply source 121*a* flows toward the nozzle row 112*a*, a valve unit 160*b* in which the ink from the liquid supply source 121*b* flows toward the nozzle row 112*b*, the valve unit 160*c* in which the ink from the liquid supply source 121*c* flows toward the nozzle row 112*c*, and the valve unit 160*d* in which the ink from the liquid supply source 121*d* flows toward the nozzle row 112*d*.

The transport mechanism 130 transports the printing paper P in the sub-scanning direction. The sub-scanning direction is a direction orthogonal to the X axis direction which is the main scanning direction, and in the present embodiment, the sub-scanning directions are the +Y direction and the −Y direction. The transport mechanism 130 is provided with a transport rod 134 on which three transport rollers 132 are mounted, and a transport motor 136 that rotationally drives the transport rod 134. When the transport motor 136 rotationally drives the transport rod 134, the plurality of transport rollers 132 rotate and the printing paper P is transported in the +Y direction in the sub-scanning direction. The number of transport rollers 132 is not limited to three and may be any number. In addition, a configuration may be adopted in which a plurality of transport mechanisms 130 are provided.

In addition to the carriage 142 described above, the moving mechanism 140 is provided with a transport belt 144, a moving motor 146, and a pulley 147. The carriage 142 mounts the liquid ejecting head 110 and the valve unit 160 in a state where ink can be ejected. The carriage 142 is attached to the transport belt 144. The transport belt 144 is bridged between the moving motor 146 and the pulley 147. When the moving motor 146 is rotationally driven, the transport belt 144 reciprocates in the main scanning direction. As a result, the carriage 142 attached to the transport belt 144 also reciprocates in the main scanning direction.

The maintenance portion 150 performs maintenance of the liquid ejecting head 110. The maintenance portion 150 includes a wiper 151, a wiper drive portion 152, a cap 153, a cap holding portion 154, a cap drive portion 155, a waste liquid tube 156, a suction pump 157, and a waste liquid collection portion 158.

The wiper 151 performs maintenance of the liquid ejecting head 110 by wiping the nozzle surface 111 of the liquid ejecting head 110. By driving the wiper drive portion 152, the wiper 151 moves in the Z axis direction between a standby position that does not contact the nozzle surface 111 and a wiping position that can contact the nozzle surface 111. With the wiper 151 in the wiping position, the liquid ejecting head 110 moves in the −Z direction side of the wiper 151 in the main scanning direction along with the movement of the carriage 142, so that the nozzle surface 111 is wiped.

The cap 153 performs maintenance of the liquid ejecting head 110 by discharging ink from the nozzle N of the liquid ejecting head 110. The cap 153 contacts the nozzle surface 111 of the liquid ejecting head 110 to form a suction space to which a plurality of nozzles N are open. The cap 153 is held by the cap holding portion 154. The cap holding portion 154 moves in the Z axis direction by driving the cap drive portion 155. The cap 153 moves in the Z axis direction between a non-capping position that does not contact the nozzle surface 111 and a suctionable position that contacts the nozzle surface 111 by moving the cap holding portion 154 in the Z axis direction. The cap 153 communicates with the waste liquid collection portion 158 that collects the waste liquid via the waste liquid tube 156. The waste liquid tube 156 is provided with a suction pump 157 for sucking the suction space formed by the cap 153.

When maintenance of the liquid ejecting head 110 is performed by the cap 153, with the cap 153 in the non-capping position, the movement of the carriage 142 causes the liquid ejecting head 110 to move to a position where the nozzle rows 112*a*, 112*b*, 112*c*, and 112*d* face the cap 153. By moving the cap 153 to the suctionable position, a suction space is formed to which the plurality of nozzles N constituting the nozzle rows 112*a*, 112*b*, 112*c*, and 112*d* are open. When the suction pump 157 sucks the formed suction space, ink is discharged into the suction space from the plurality of nozzles N constituting the nozzle rows 112*a*, 112*b*, 112*c*, and 112*d*. The ink discharged into the suction space is collected in the waste liquid collection portion 158 via the waste liquid tube 156.

The control portion 190 controls the entire liquid ejecting apparatus 1100. For example, the control portion 190 controls a reciprocating operation along the main scanning direction of the carriage 142, a transport operation along the sub-scanning direction of the printing paper P, an ink ejection operation of the liquid ejecting head 110, and a maintenance operation of the liquid ejecting head 110 by the maintenance portion 150. The control portion 190 may include, for example, a processing circuit such as a Central Processing Unit (CPU) or a Field Programmable Gate Array (FPGA) and a storage circuit such as a semiconductor memory.

Figure 23:
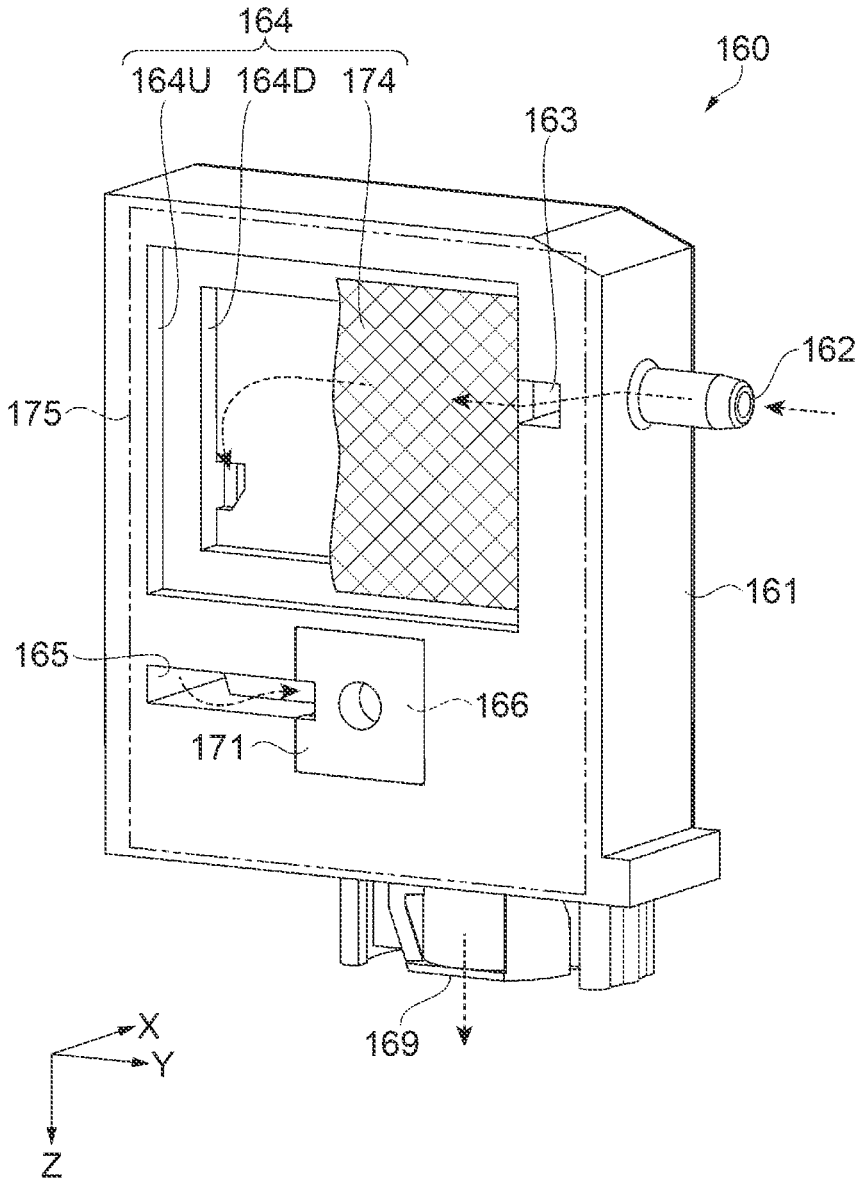
FIG. 23 is a perspective view illustrating a valve unit viewed from a supply chamber side.

Next, a detailed configuration of the valve unit 160 will be described with reference to the drawings. In FIGS. 23 and 25, only an outer shape of a first thin film 175 is illustrated by a two-dot chain line for the purpose of describing the internal structure of the valve unit 160. In addition, in FIGS. 24 and 27, only an outer shape of a second thin film 176 is illustrated by a two-dot chain line for the purpose of describing the internal structure of the valve unit 160. In addition, in FIG. 23, a portion of a filter 174 is deleted for the purpose of describing the internal structure of a filter chamber 164. In addition, in FIGS. 25 and 26, a spring seat 171 is deleted for the purpose of describing the internal structure of a supply chamber 166.

As illustrated in FIGS. 23 to 31, the valve unit 160 is provided with a base 161, a valve 172, a compression coil spring 173, and a displacement body 180. The base 161 is provided with an inflow portion 162, an inflow flow path 163, a filter chamber 164, a relay flow path 165, a supply chamber 166, a communication flow path 167, a pressure chamber PC, an outflow flow path 168D, and an outflow portion 169. The inflow flow path 163, the filter chamber 164, and the supply chamber 166 are formed by fixing the first thin film 175 to the base 161 so as to cover the side surface of the base 161 on the −X direction side. The pressure chamber PC is formed by fixing the second thin film 176 to the base 161 so as to cover the side surface of the base 161 on the +X direction side. The relay flow path 165 is formed by fixing the first thin film 175 to the side surface of the base 161 on the −X direction side and fixing the second thin film 176 to the side surface on the +X direction side.

The material for forming the base 161 may be any material, and the base 161 in the present embodiment is formed of an olefin resin. In addition, the first thin film 175 and the second thin film 176 in the present embodiment are formed of a multilayer film. As the multilayer film, for example, a multilayer film using polypropylene having a thickness of 25 μm as a layer on the pressure chamber PC side and using polyethylene terephthalate having a thickness of 12 μm and subjected to alumina vapor deposition or silica vapor deposition as a layer on the outer space side can be used. As a result, a flexible portion FP capable of ensuring gas barrier properties can be obtained. In the present embodiment, the base 161 is formed of polypropylene, which is the same material as the layer of the first thin film 175 and the second thin film 176 on the pressure chamber PC side, and the first thin film 175 and the second thin film 176 are fixed to the base 161 by heat welding.

As illustrated in FIGS. 23 and 25, the inflow portion 162 is provided at a position in the −Z direction of the center on side surface of the base 161 of the valve unit 160 on the +Y direction side. The inflow portion 162 has a cylindrical shape protruding in the +Y direction from the side surface of the base 161 on the +Y direction side. Ink from the liquid supply source 121 flows into the inflow portion 162 via the tube 125.

Figure 28:
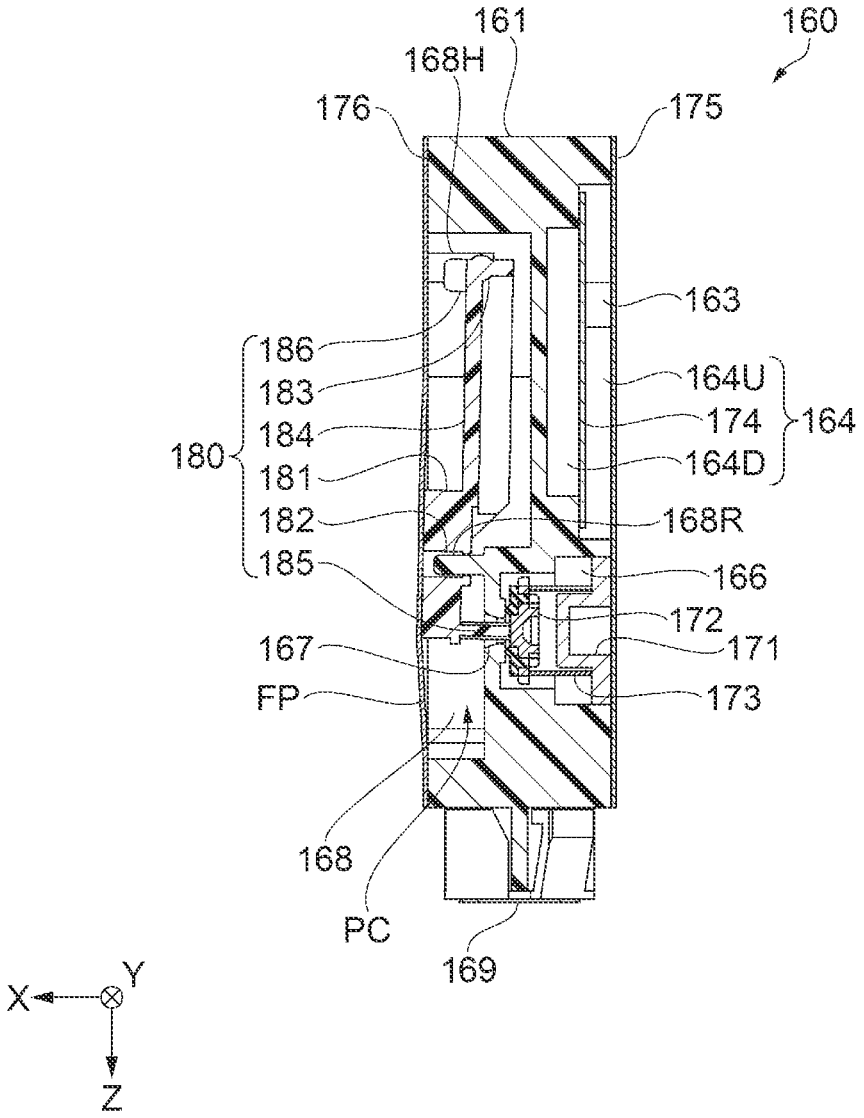
FIG. 28 is a cross-sectional view illustrating an XXVIII-XXVIII cross section of the valve unit in a closed state of a valve illustrated in FIG. 27.

As illustrated in FIGS. 23, 25, and 28, the filter chamber 164 is provided on the side surface of the base 161 on the −X direction side. The filter chamber 164 includes the filter 174 capable of filtering ink, and an upstream chamber 164U and a downstream chamber 164D partitioned by the filter 174. The filter 174 is provided with multiple holes through which ink can pass and collects foreign matter. The upstream chamber 164U of the filter chamber 164 communicates with the inflow portion 162 via the inflow flow path 163. The downstream chamber 164D of the filter chamber 164 communicates with the supply chamber 166 via the relay flow path 165. As illustrated by the broken line arrows in FIGS. 23 and 24, the ink from the inflow portion 162 flows in the order of the inflow flow path 163, the upstream chamber 164U, the filter 174, the downstream chamber 164D, and the relay flow path 165, and flows into the supply chamber 166. In other words, the supply chamber 166 communicates with the inflow portion 162.

The supply chamber 166 is provided at a position in the +Z direction with respect to the filter chamber 164 on the side surface of the base 161 on the −X direction side. The supply chamber 166 stores the ink flowing in from the inflow portion 162. As illustrated in FIGS. 28 to 31, the supply chamber 166 communicates with the pressure chamber PC by the communication flow path 167. The supply chamber 166 includes a valve seat 166S and an outer peripheral regulating portion 166G. An opening of the communication flow path 167 on the supply chamber side is open to the valve seat 166S. The supply chamber 166 is provided with a valve 172, a compression coil spring 173, and a spring seat 171. In the supply chamber 166, the valve 172 is located between the valve seat 166S and the spring seat 171 in the X axis direction. The compression coil spring 173 is located between the valve 172 and the spring seat 171 in the X axis direction.

Figure 26:
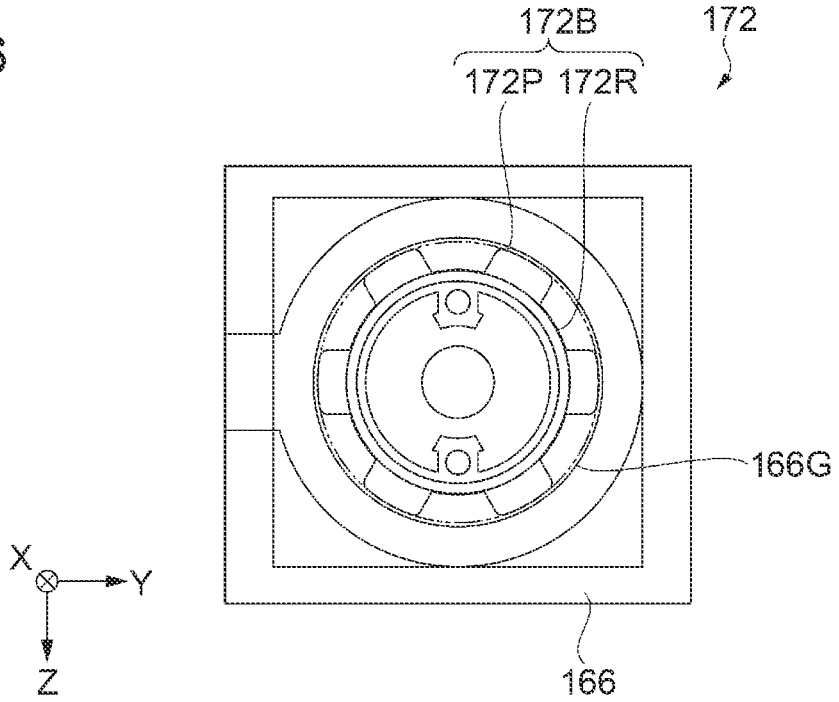
FIG. 26 is an enlarged view illustrating the supply chamber of the valve unit.

The valve 172 includes a valve body 172B and a seal portion 172S. As illustrated in FIG. 26, the valve body 172B is provided with an outer periphery 172P and a notch portion 172R. The notch portions 172R are a plurality of recessed portions formed by notching a plurality of disk-shaped outer peripheral surfaces illustrated by a two-dot chain line in FIG. 26. The outer periphery 172P is a portion of the outer peripheral surface which is not notched of the disk-shape outer peripheral surface illustrated by the two-dot chain line in FIG. 26. In the present embodiment, six notch portions 172R are provided.

Figure 29:
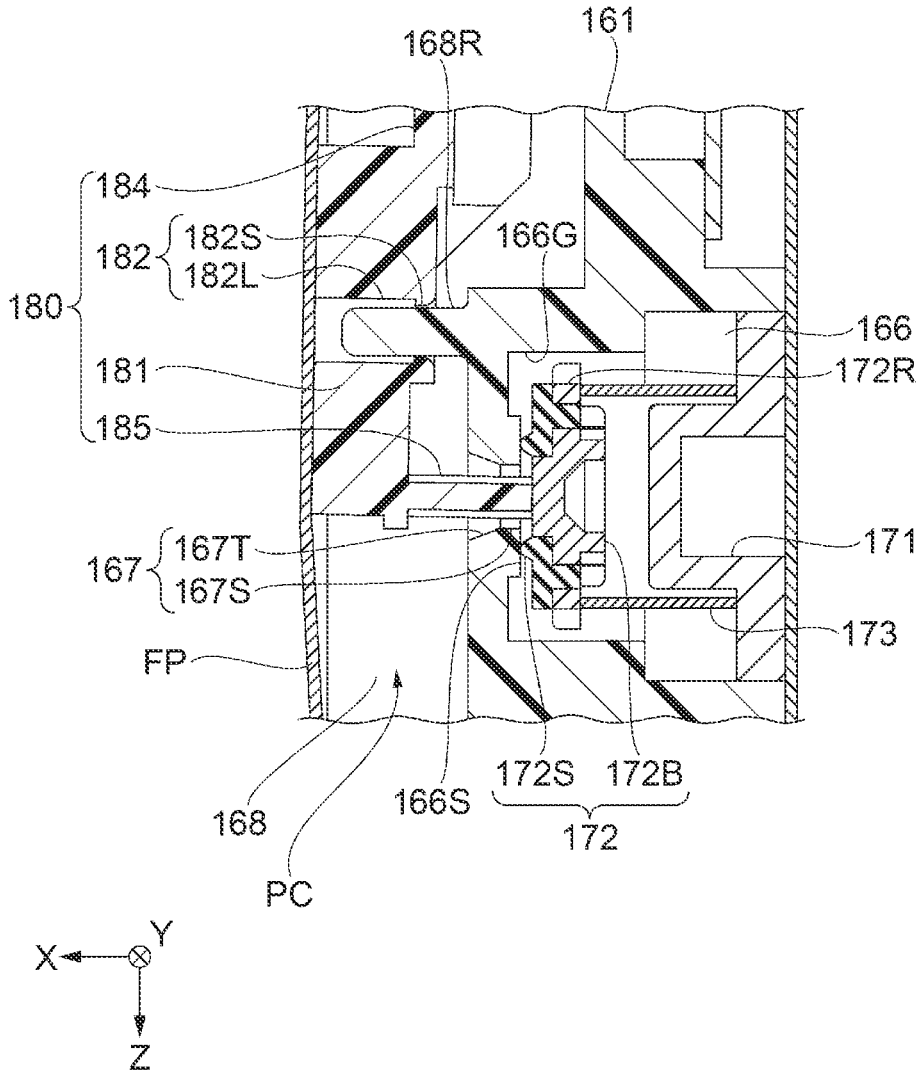
FIG. 29 is a cross-sectional view of a main part illustrating the valve unit in a closed state of the valve.

As illustrated in FIG. 29, the seal portion 172S closes the opening of the communication flow path 167 on the supply chamber side by contacting the valve seat 166S. The seal portion 172S protrudes in an annular shape in the +X direction with respect to the end portion of the valve body 172B on the +X direction side. The seal portion 172S is formed of an elastic member such as rubber or a resin elastomer.

The valve 172 is provided in the supply chamber 166 so as to be movable in the X axis direction between the open position for communicating the supply chamber 166 and the pressure chamber PC and the closed position for blocking the communication between the supply chamber 166 and the pressure chamber PC. At the closed position, the valve 172 closes the opening of the communication flow path 167 on the supply chamber side when the seal portion 172S contacts the valve seat 166S, and blocks the communication between the supply chamber 166 and the pressure chamber PC. The valve 172 allows communication between the supply chamber 166 and the pressure chamber PC at the open position where the seal portion 172S is separated from the valve seat 166S in the −X direction. In other words, the valve 172 is provided in the supply chamber 166 so that the communication flow path 167 can be opened and closed by moving in the X axis direction. In addition, the outer peripheral regulating portion 166G of the supply chamber 166 regulates the movement of the valve 172 in the direction intersecting the X axis direction by contacting the outer periphery 172P of the valve 172, and the valve 172 is smoothly moved in the X axis direction. The X axis direction is an example of the opening and closing direction.

The compression coil spring 173 biases the valve 172 from the open position toward the closed position in the +X direction. In addition, the compression coil spring 173 presses the valve 172 toward the valve seat 166S in the closed position. In other words, the compression coil spring 173 biases the valve 172 in the direction of closing the communication flow path 167. The compression coil spring 173 is an example of a biasing member.

As illustrated in FIG. 29, the communication flow path 167 that communicates the supply chamber 166 and the pressure chamber PC includes a supply chamber side communication portion 167S that is open on the supply chamber 166 side and a pressure chamber side communication portion 167T that is open on the pressure chamber PC side. The inner diameter of the supply chamber side communication portion 167S is the same as the opening diameter on the supply chamber side. The pressure chamber side communication portion 167T extends from the supply chamber 166 side toward the pressure chamber PC side. Therefore, the inner diameter of the pressure chamber side communication portion 167T coupled to the supply chamber side communication portion 167S is the same as the inner diameter of the supply chamber side communication portion 167S, and the opening diameter on the pressure chamber side that is open on the pressure chamber PC side is larger than the opening diameter on the supply chamber side. In other words, the communication flow path 167 extends from the supply chamber 166 toward the pressure chamber PC.

Figure 24:
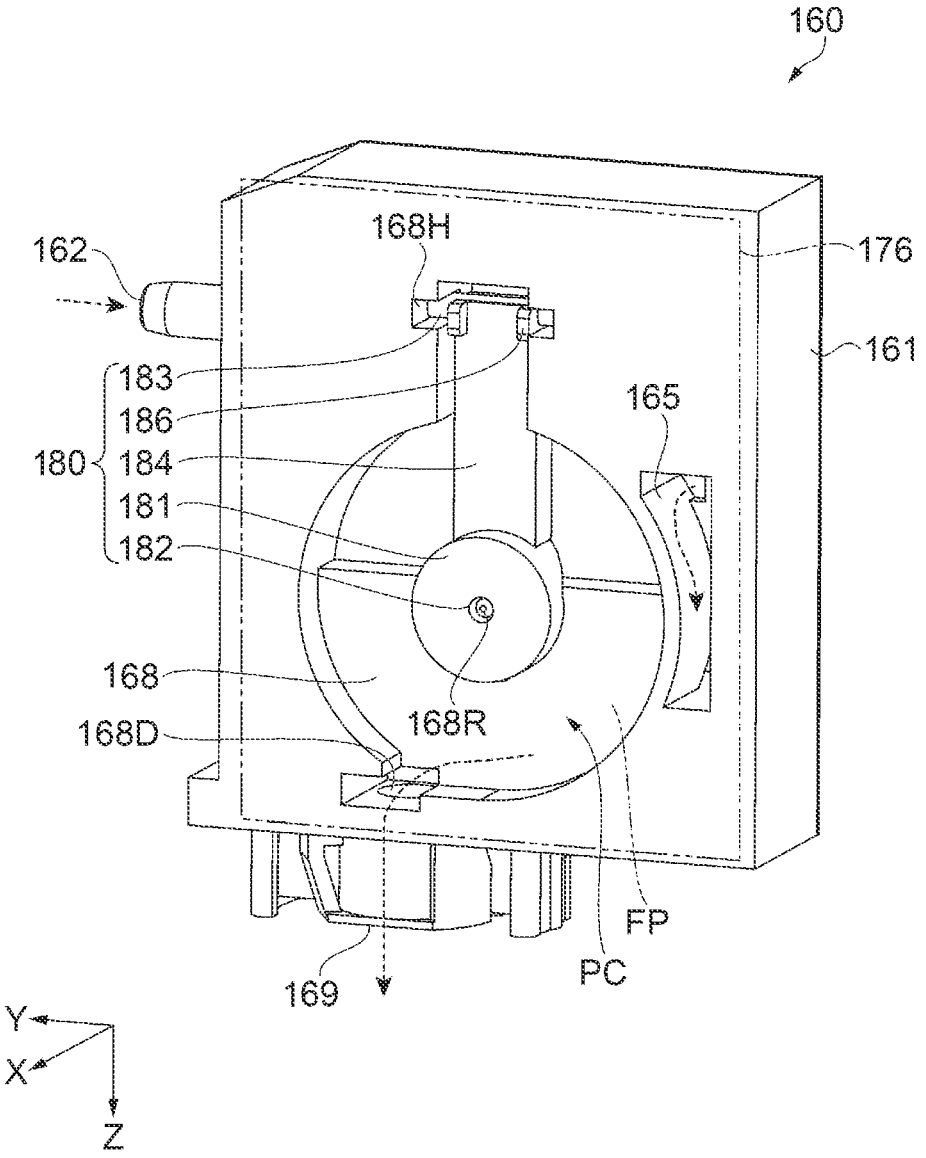
FIG. 24 is a perspective view illustrating the valve unit viewed from a pressure chamber side.
Figure 25:
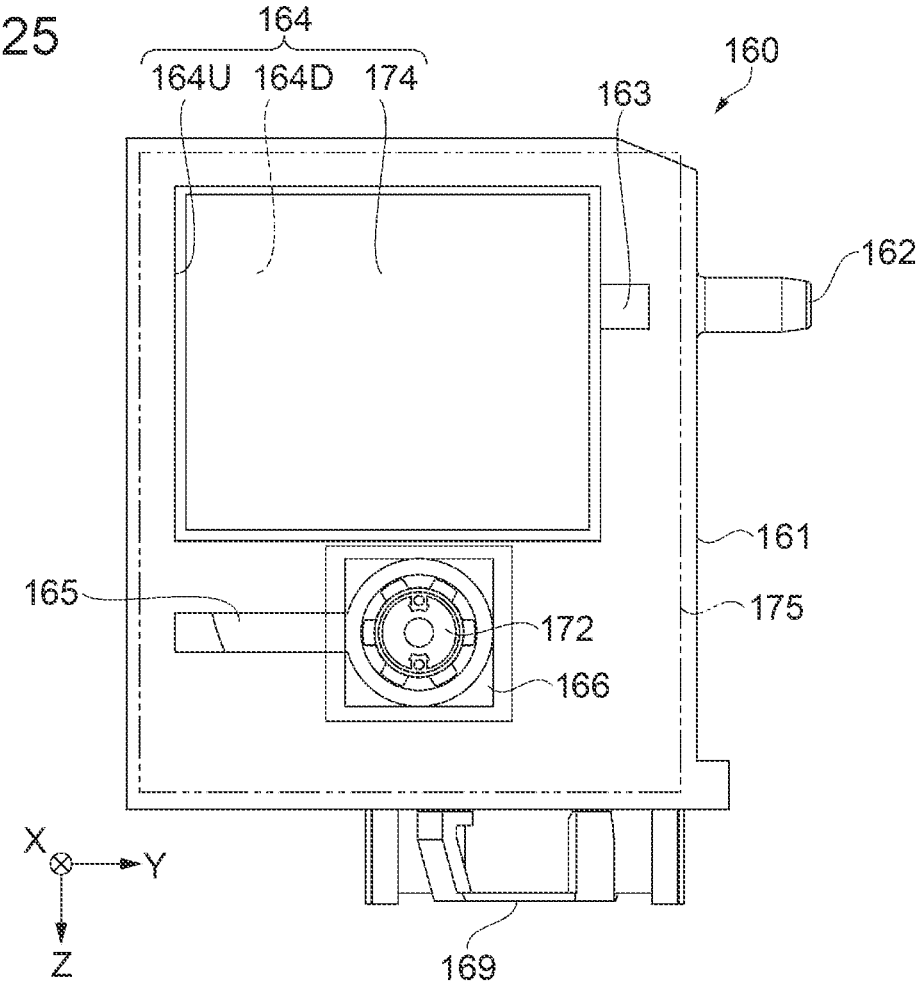
FIG. 25 is a side view illustrating the valve unit viewed from the supply chamber side.
Figure 27:
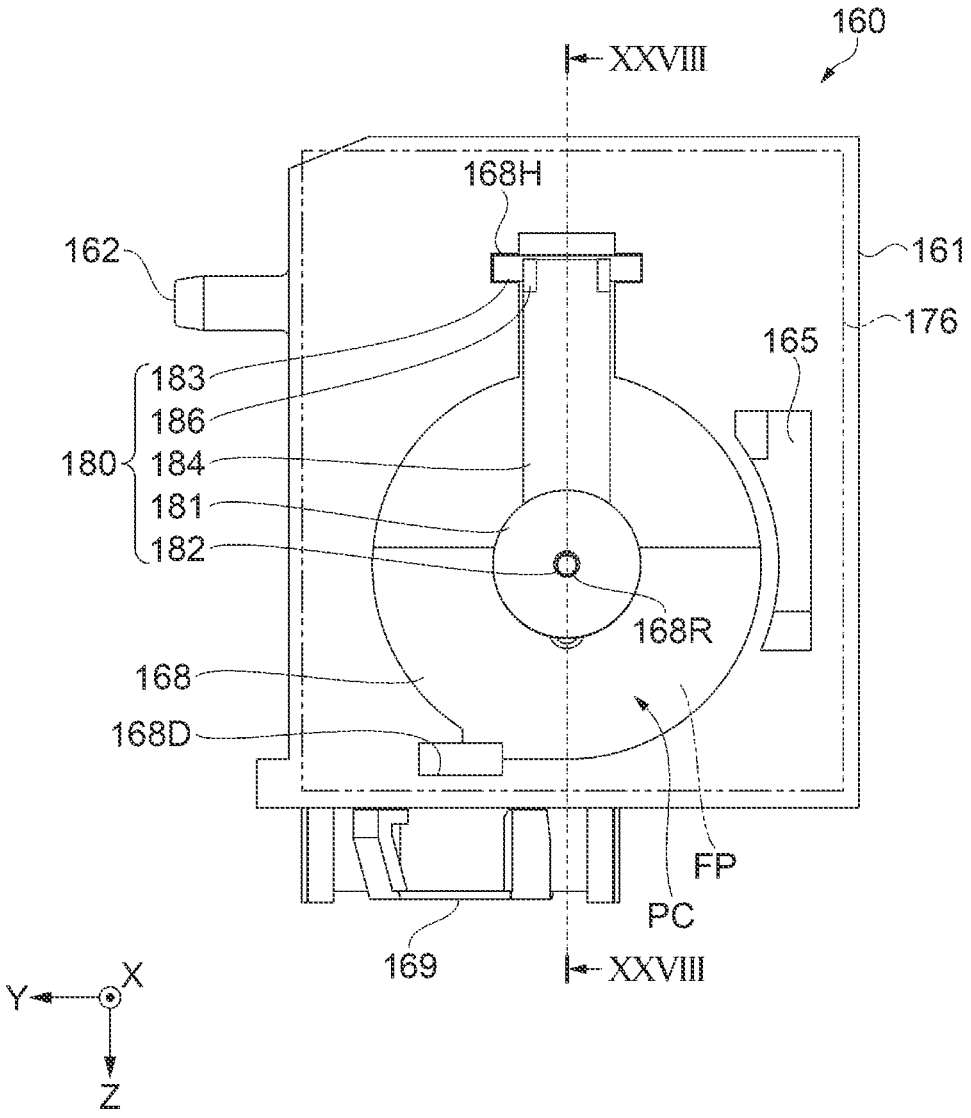
FIG. 27 is a side view illustrating the valve unit viewed from the pressure chamber side.

As illustrated in FIGS. 24 and 27, the pressure chamber PC includes a recessed portion 168 formed on the side surface of the base 161 on the +X direction side, and the flexible portion FP. The recessed portion 168 has a portion that partially extends outward when viewed from the +X direction, and has a substantially circular shape. The flexible portion FP is a portion that covers the recessed portion 168 of the second thin film 176 covering the side surface of the base 161 on the +X direction side. Therefore, the flexible portion FP has flexibility and has a substantially circular shape when viewed from the +X direction. Therefore, the center of the flexible portion FP is likely to be displaced. The pressure chamber PC has a substantially circular shape when viewed from the +X direction. In addition, when the flexible portion FP is displaced, the volume of the pressure chamber PC changes.

As illustrated in FIGS. 24 and 27, the outflow portion 169 is provided at a position in the +Y direction of the center on the side surface of the base 161 on the +Z direction side. The outflow portion 169 has a cylindrical shape protruding in the +Z direction from the side surface of the base 161 on the +Z direction side. The pressure chamber PC communicates with the outflow portion 169 via the outflow flow path 168D that is open to a position in the +Z direction of the center of the pressure chamber PC. As illustrated by the broken line arrow in FIG. 24, the ink of the pressure chamber PC flows out from the outflow portion 169 and flows into the liquid ejecting head 110 coupled to the outflow portion 169.

The pressure chamber PC is provided with a displacement body 180. The displacement body 180 includes a pressure receiving portion 181, an engaging portion 182, a rotation shaft 183, a coupling portion 184, a shaft portion 185, and a protrusion 186. As illustrated in FIGS. 24 and 27, the pressure receiving portion 181 has a disk shape and is circular when viewed from the +X direction. An engaging portion 182 is provided at the center of the pressure receiving portion 181. The engaging portion 182 is a hole that penetrates the pressure receiving portion 181. The coupling portion 184 has a wide thin plate shape and extends from the pressure receiving portion 181. The rotation shaft 183 is provided at the end portion of the coupling portion 184 in the direction extending from the pressure receiving portion 181. The material for forming the displacement body 180 may be any material, and the displacement body 180 may be formed of a material different from those of the base 161 and the layer of the second thin film 176 on the pressure chamber PC side. In the present embodiment, the displacement body 180 is formed of polyacetal. As a result, when the second thin film 176 is heat-welded to the base 161, it is possible to prevent the displacement body 180 from being fixed to either the base 161 or the second thin film 176.

The rotation shaft 183 has a cylindrical shape protruding from the coupling portion 184 on both sides in the width direction of the coupling portion 184. In addition, the protrusion 186 is provided at an end portion in the direction where the coupling portion 184 extends from the pressure receiving portion 181. As illustrated in FIGS. 28 and 29, the shaft portion 185 is provided at a position in the pressure receiving portion 181 in a direction opposite to the direction where the coupling portion 184 extends from the pressure receiving portion 181. In other words, the shaft portion 185 is provided at a position different from that of the engaging portion 182 in the pressure receiving portion 181. The shaft portion 185 is a rod-shaped protrusion protruding from the pressure receiving portion 181. The distance from the rotation shaft 183 to the shaft portion 185 is longer than the distance from the rotation shaft 183 to the engaging portion 182.

As illustrated in FIGS. 24 and 27, the pressure chamber PC includes an engaged portion 168R that engages with the engaging portion 182 and a support portion 168H that supports the rotation shaft 183. The engaged portion 168R is provided at the center of an inner bottom surface of the recessed portion 168. That is, the engaged portion 168R is located at the center of the circular pressure chamber PC when the pressure chamber PC is viewed from the +X direction. As illustrated in FIGS. 28 and 29, the engaged portion 168R is a round bar-shaped protrusion protruding in the +X direction from the inner bottom surface of the recessed portion 168. As illustrated in FIGS. 24, 27, and 28, the support portion 168H is provided at a position in the −Z direction with respect to the engaged portion 168R. The support portion 168H is a recess provided in a portion extending in the −Z direction from the circular portion of the recessed portion 168. The support portion 168H supports the rotation shaft 183 so that the displacement body 180 can rotate around the rotation shaft 183. In addition, as illustrated in FIGS. 28 and 29, the opening of the communication flow path 167 on the pressure chamber side is open to a position in the pressure chamber PC in the +Z direction with respect to the engaged portion 168R.

As illustrated in FIGS. 24 and 27, in a state where the displacement body 180 is provided in the pressure chamber PC, the engaging portion 182 is located at the center of the pressure chamber PC when viewed from the +X direction by inserting the engaged portion 168R. In the state where the displacement body 180 is provided in the pressure chamber PC, the rotation shaft 183 is located at a position in the −Z direction with respect to the engaging portion 182. In addition, in a state where the displacement body 180 is provided in the pressure chamber PC, the rotation shaft 183 is supported by the support portion 168H so that the rotation shaft 183 on which the displacement body 180 rotates is along the Y axis.

As illustrated in FIGS. 28 and 29, in a state where the displacement body 180 is provided in the pressure chamber PC, the shaft portion 185 is located at a position in the +Z direction with respect to the engaging portion 182 when viewed from the +X direction. In other words, the engaging portion 182 is provided between the shaft portion 185 and the rotation shaft 183 in the Z axis direction. In addition, as illustrated in FIGS. 27 and 28, in a state where the displacement body 180 is provided in the pressure chamber PC, the engaging portion 182 and the shaft portion 185 are located between at both end portions of the rotation shaft 183 in the Y axis direction. In a state where the displacement body 180 is provided in the pressure chamber PC, the protrusion 186 protrudes in the +X direction from the coupling portion 184 while ensuring a gap with the flexible portion FP. The protrusions 186 are provided at two positions at intervals in the Y axis direction, corresponding to the rotation shaft 183. As a result, the protrusion 186 suppresses the rotation shaft 183 from moving from the support portion 168H in the +X direction and coming off.

As illustrated in FIGS. 24 and 27, in the state where the displacement body 180 is provided in the pressure chamber PC, the engaging portion 182 engages with the engaged portion 168R, so that the engaging portion 182 is rotatably positioned with respect to the pressure chamber PC with the engaged portion 168R as the center of rotation. In other words, by engaging the engaging portion 182 with the engaged portion 168R, the movement of the displacement body 180 in the direction intersecting the X axis direction is restricted. When the support portion 168H comes into contact with both end portions of the rotation shaft 183, the displacement body 180 is restricted from rotating around the engaged portion 168R and is positioned with respect to the pressure chamber PC. In addition, as illustrated in FIG. 28, the distance from the engaging portion 182 to the shaft portion 185 is set shorter than the distance from the engaging portion 182 to the rotation shaft 183. As a result, the shaft portion 185 is accurately positioned with respect to the communication flow path 167 of the pressure chamber PC. As illustrated in FIG. 29, in a state where the displacement body 180 is provided in the pressure chamber PC, the tip end side of the shaft portion 185 is located in the communication flow path 167, and the tip end of the shaft portion 185 is in contact with the end portion of the valve body 172B on the +X direction side in the valve 172.

Figure 30:
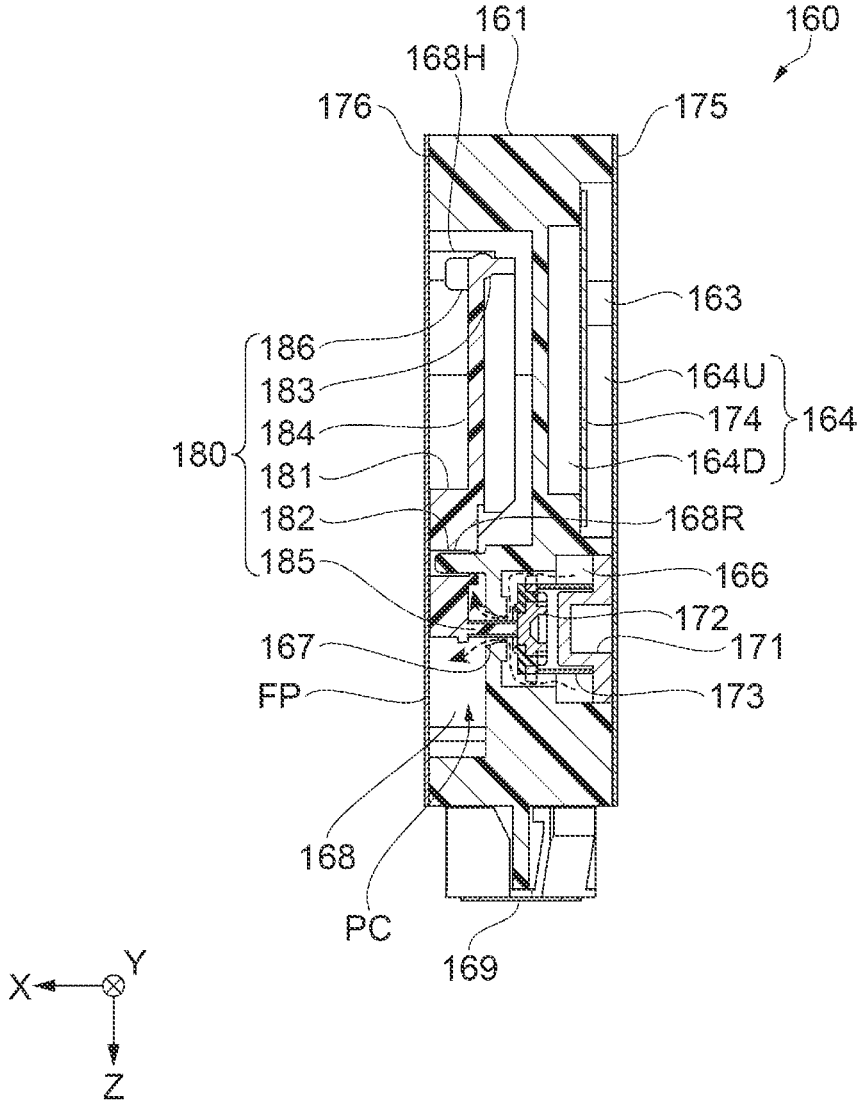
FIG. 30 is a cross-sectional view illustrating the valve unit in an open state of the valve.
Figure 31:
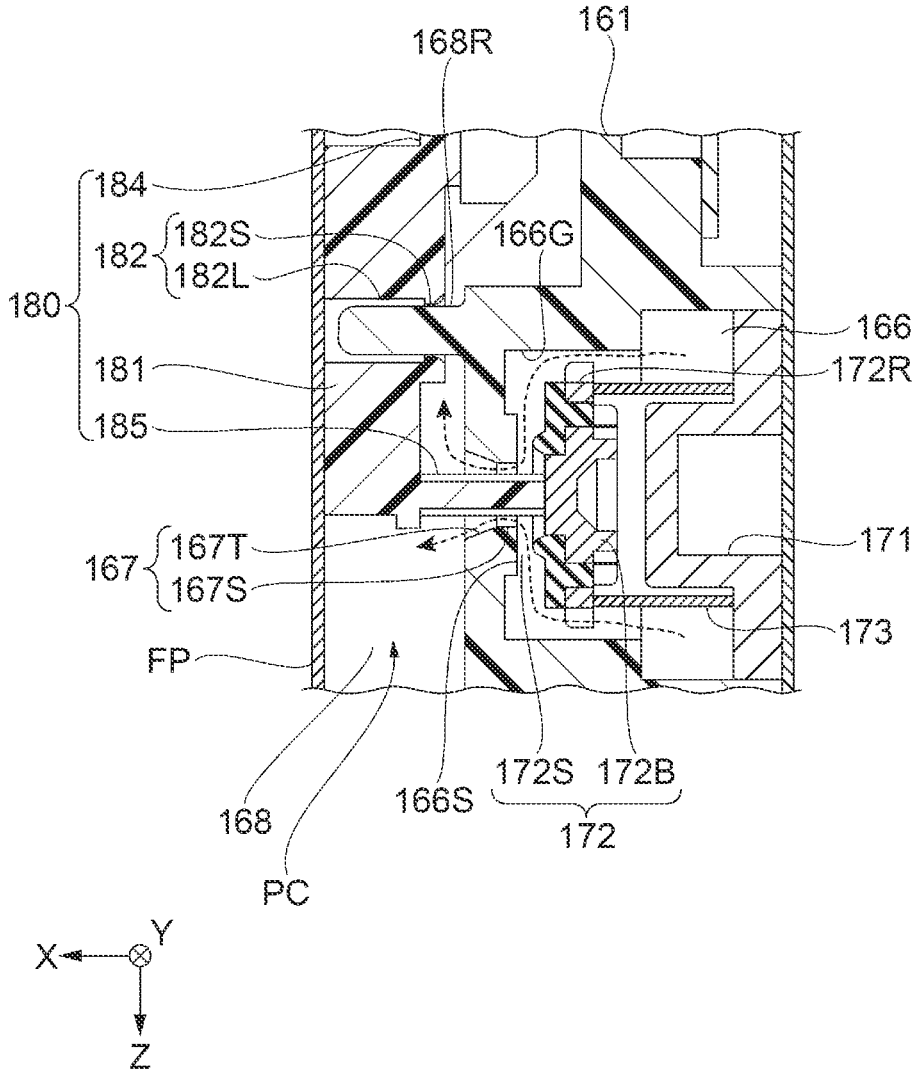
FIG. 31 is a cross-sectional view of a main part illustrating the valve unit in an open state of the valve.

In the valve unit 160, when the magnitude of the negative pressure in the pressure chamber PC is larger than the predetermined negative pressure, the valve 172 in the closed position illustrated in FIGS. 28 and 29 moves to the open position illustrated in FIGS. 30 and 31 to open the communication flow path 167. When the communication flow path 167 opens, ink flows from the supply chamber 166 into the pressure chamber PC as illustrated by the broken line arrows in FIGS. 30 and 31, and the magnitude of the negative pressure in the pressure chamber PC is a predetermined negative pressure, the valve 172 in the open position moves to the closed position and closes the communication flow path 167. As a result, the valve unit 160 regulates the pressure of the ink supplied to the liquid ejecting head 110 to a predetermined negative pressure.

In the present embodiment, it is assumed that the predetermined negative pressure is set to −0.5 kPa in gauge pressure at the position of the nozzle surface 111, for example, in the Z axis direction, and the central position of the pressure chamber PC is separated from the nozzle surface 111 in the −Z direction by 30 mm. In this case, when the magnitude of the negative pressure in the pressure chamber PC is larger than −0.8 kPa in gauge pressure, the valve 172 opens the communication flow path 167. When the communication flow path 167 opens, ink flows from the supply chamber 166 into the pressure chamber PC, and the magnitude of the negative pressure in the pressure chamber PC reaches −0.8 kPa in gauge pressure, the valve 172 closes the communication flow path 167.

As illustrated in FIGS. 28 to 31, in a state where the displacement body 180 is provided in the pressure chamber PC, the pressure receiving portion 181 is in contact with the center of the flexible portion FP on the pressure chamber PC side. When the magnitude of the negative pressure in the liquid ejecting head 110 communicating with the pressure chamber PC is larger than the predetermined negative pressure, the biasing force that the compression coil spring 173 presses the valve 172 toward the valve seat 166S is set so that the valve 172 moves from the closed position to the open position and opens the communication flow path 167. Therefore, the tip end of the shaft portion 185 in contact with the valve 172 is pushed in the +X direction with a force larger than a force required to deform the flexible portion FP. As a result, as illustrated in FIGS. 28 and 29, when the valve 172 is located in the closed position, the pressure receiving portion 181 pushes the flexible portion FP so that the central position of the flexible portion FP is located in the +X direction with respect to the central position of the flexible portion FP illustrated in FIGS. 30 and 31.

The center position of the pressure receiving portion 181 provided with the engaging portion 182 is a position closer to the rotation shaft 183 as compared with the shaft portion 185. In addition, the distance from the shaft portion 185 to the rotation shaft 183 is longer than the distance from the shaft portion 185 to the center position of the pressure receiving portion 181. Therefore, when the pressure receiving portion 181 and the flexible portion FP are in contact with each other, the rotation shaft 183 is biased toward a support surface of the support portion 168H on the −X direction side. As a result, the position of the center of rotation of the displacement body 180 is stable, and the displacement body 180 can move smoothly.

When the negative pressure in the pressure chamber PC increases due to the fact that ink is ejected from the nozzle N of the liquid ejecting head 110 in the printing operation of the liquid ejecting apparatus 1100 and the ink is discharged from the nozzle N in the maintenance operation, the flexible portion FP is deformed in the direction where the volume of the pressure chamber PC decreases. When the negative pressure in the pressure chamber PC is larger than the predetermined negative pressure, the central position of the flexible portion FP moves in the −X direction from the positions illustrated in FIGS. 28 and 29. As a result, the pressure receiving portion 181 moves in the −X direction, and the displacement body 180 rotates about the rotation shaft 183 in the direction where the shaft portion 185 moves in the −X direction. When the shaft portion 185 moves the valve 172 in the closed position in the −X direction, the valve 172 moves to the open position illustrated in FIGS. 30 and 31 and opens the communication flow path 167.

The communication flow path 167 opens, and ink flows from the supply chamber 166 into the pressure chamber PC as illustrated by the broken line arrows in FIGS. 30 and 31. In the present embodiment, the communication flow path 167 is not used for positioning the valve 172. In addition, in the present embodiment, the communication flow path 167 is not used for positioning the shaft portion 185. Therefore, according to the present embodiment, as compared with the case where, for example, the communication flow path 167 is used for positioning the valve 172, it is easy to secure a passage through which ink can pass between the shaft portion 185 and the communication flow path 167. In addition, in the present embodiment, the valve body 172B of the valve 172 is provided with the notch portion 172R. Therefore, in the supply chamber 166, a passage through which ink can pass is formed between the outer peripheral regulating portion 166G of the supply chamber 166 and the notch portion 172R of the valve body 172B.

In addition, as illustrated in FIG. 29, the engaging portion 182 includes an insertion side hole portion 182S that is open on the side into which the engaged portion 168R is inserted and a flexible portion side hole portion 182L that is open on the flexible portion FP side. The insertion side hole portion 182S is a through-hole whose hole size is set so as to come into contact with the engaged portion 168R. When the insertion side hole portion 182S comes into contact with the engaged portion 168R, the movement of the displacement body 180 in the direction intersecting the X axis direction is restricted. The flexible portion side hole portion 182L is a through-hole whose hole size is set so as not to come into contact with the engaged portion 168R. Therefore, the hole size of the flexible portion side hole portion 182L is larger than the hole size of the insertion side hole portion 182S.

In addition, the length of the flexible portion side hole portion 182L in the X axis direction is set so as to correspond to the position of the tip end portion of the engaged portion 168R that moves relative to the inside of the engaging portion 182 by the movement of the displacement body 180. Therefore, the dimension of the flexible portion side hole portion 182L in the X axis direction is larger than the dimension of the insertion side hole portion 182S in the X axis direction. In other words, the engaging portion 182 includes the insertion side hole portion 182S including an opening into which the engaged portion 168R is inserted. The size of the hole of the flexible portion side hole portion 182L provided at the position corresponding to the tip end of the inserted engaged portion 168R is larger than the size of the hole of the insertion side hole portion 182S at the position of the opening into which the engaged portion 168R is inserted. When the displacement body 180 rotates about the rotation shaft 183, the engaging portion 182 may be tilted with respect to the engaged portion 168R as illustrated in FIG. 29. On the other hand, since the engaging portion 182 of the present embodiment includes the insertion side hole portion 182S and the flexible portion side hole portion 182L, the displacement body 180 can move smoothly while maintaining the engaged state where the insertion side hole portion 182S is in contact with the engaged portion 168R.

For example, when the communication flow path 167 of the valve unit 160 is used for positioning the valve 172, it is difficult to secure a large passage through which the ink can pass in the communication flow path 167, and there is a possibility that the pressure loss when the ink flows through the communication flow path 167 increases. On the other hand, the valve unit 160 of the present embodiment is provided in the pressure chamber PC and is provided with the displacement body 180 that can be displaced according to the displacement of the flexible portion FP. The displacement body 180 includes the shaft portion 185 that is inserted into the communication flow path 167 to open and close the valve 172, and the engaging portion 182 that is provided at a position different from that of the shaft portion 185. By engaging the engaging portion 182 with the engaged portion 168R provided in the pressure chamber PC, the movement of the displacement body 180 in the direction intersecting the X axis direction is restricted.

As a result, since the communication flow path 167 is not used for positioning, it is easy to form a large passage through which the ink can pass in the communication flow path 167, and it is easy to reduce the pressure loss when the ink flows through the communication flow path 167. In addition, since the liquid ejecting apparatus 1100 of the present embodiment is provided with the valve unit 160 described above, it is easy to reduce the pressure loss when the ink flows through the supply flow path 124.

As described above, according to the valve unit 160 and the liquid ejecting apparatus 1100 according to the second embodiment, the following effects can be obtained.

The valve unit 160 includes the inflow portion 162 in which ink flows in, the outflow portion 169 in which ink flows out, the supply chamber 166 communicating with the inflow portion 162, the pressure chamber PC having the flexible portion FP communicating with the outflow portion 169 and having flexibility, the valve 172 provided in the supply chamber 166 and capable of opening and closing the communication flow path 167 communicating the supply chamber 166 and the pressure chamber PC by moving in the X axis direction, the compression coil spring 173 biasing the valve 172 in the direction of closing the communication flow path 167, and the displacement body 180 provided in the pressure chamber PC and displaceable according to the displacement of the flexible portion FP, in which the displacement body 180 has the shaft portion 185 inserted into the communication flow path 167 to open and close the valve 172, and the engaging portion 182 provided at a position different from that of the shaft portion 185, and by engaging the engaging portion 182 with the engaged portion 168R provided in the pressure chamber PC, the movement of the displacement body 180 in the direction intersecting the X axis direction is restricted. As a result, since the communication flow path 167 is not used for positioning, it is easy to form a large passage through which the ink can pass in the communication flow path 167, and it is easy to reduce the pressure loss when the ink flows through the communication flow path 167.

The displacement body 180 includes the circular pressure receiving portion 181 that receives the displacement of the flexible portion FP, and the engaging portion 182 is provided at the center of the pressure receiving portion 181. As a result, the displacement body 180 can be smoothly moved.

The supply chamber 166 includes the outer peripheral regulating portion 166G that regulates the movement of the valve 172 in a direction intersecting the X axis direction by contacting the outer periphery 172P of the valve 172. As a result, a positional variation of the valve 172 can be reduced.

The valve 172 includes a plurality of notch portions 172R. As a result, since a plurality of passages through which ink can pass can be formed between the outer peripheral regulating portion 166G and the valve 172, a pressure loss when ink flows between the outer peripheral regulating portion 166G and the valve 172 can be further reduced.

The displacement body 180 includes the rotation shaft 183 supported by the base 161 constituting the pressure chamber PC, and is rotatable about the rotation shaft 183. As a result, since the posture of the displacement body 180 can be stabilized, the valve 172 can be smoothly opened and closed.

The engaging portion 182 is provided between the shaft portion 185 and the rotation shaft 183. As a result, since the posture of the displacement body 180 can be further stabilized, the valve 172 can be smoothly opened and closed.

The engaged portion 168R is formed in a rod shape, and the engaging portion 182 includes the insertion side hole portion 182S including an opening into which the engaged portion 168R is inserted. The size of the hole of the flexible portion side hole portion 182L provided at the position corresponding to the tip end of the inserted engaged portion 168R is larger than the size of the hole of the insertion side hole portion 182S at the position of the opening into which the engaged portion 168R is inserted. As a result, the displacement body 180 can move smoothly in a state where the engaging portion 182 is engaged with the engaged portion 168R.

The communication flow path 167 extends from the supply chamber 166 toward the pressure chamber PC. As a result, the pressure loss when the ink flows through the communication flow path 167 can be further reduced.

The liquid ejecting apparatus 1100 includes the liquid ejecting head 110 for ejecting ink, the supply flow path 124 in which ink flows from the liquid supply source 121 toward the liquid ejecting head 110, and the valve unit 160 that constitutes a portion of the supply flow path 124 and has the inflow portion 162 in which ink from the liquid supply source 121 flows in and the outflow portion 169 in which ink flows out toward the liquid ejecting head 110, in which the valve unit 160 has the supply chamber 166 communicating with the inflow portion 162, the pressure chamber PC having the flexible portion FP communicating with the outflow portion 169 and having flexibility, the valve 172 provided in the supply chamber 166 and capable of opening and closing the communication flow path 167 communicating the supply chamber 166 and the pressure chamber PC by moving in the X axis direction, the compression coil spring 173 biasing the valve 172 in the direction of closing the communication flow path 167, and the displacement body 180 provided in the pressure chamber PC and displaceable according to the displacement of the flexible portion FP, the displacement body 180 has the shaft portion 185 inserted into the communication flow path 167 to open and close the valve 172, and the engaging portion 182 provided at a position different from that of the shaft portion 185, and by engaging the engaging portion 182 with the engaged portion 168R provided in the pressure chamber PC, the movement of the displacement body 180 in the direction intersecting the X axis direction is restricted. As a result, since the communication flow path 167 is not used for positioning, it is easy to increase the passage through which the ink can pass in the communication flow path 167, and it is easy to reduce the pressure loss when the ink flows through the communication flow path 167.

The liquid ejecting apparatus 1100 is further provided with the liquid supply source 121 including the filling portion 122 capable of filling ink and the housing chamber 123 containing ink filled from the filling portion 122. As a result, the liquid ejecting apparatus 1100 can also be adopted for a printer having a specification of filling ink into the housing chamber 123.

The valve unit 160 and the liquid ejecting apparatus 1100 according to the above embodiment of the present disclosure are based on having the above-described configuration, and as a matter of course, it is also possible to change or omit a partial configuration within a range that does not deviate from the gist of the present disclosure. In addition, the above embodiment and the other embodiments described below can be implemented in combination with each other to the extent that these embodiments are technically consistent. Hereinafter, other embodiments will be described.

In the above embodiment, the shape of the pressure receiving portion 181 may not be circular. In this case, for example, the shape of the pressure receiving portion 181 may be an ellipse or a polygon.

In the above embodiment, the engaging portion 182 may not be a circular through-hole. In this case, the shape of the engaging portion 182 may be an ellipse or a polygon.

In the above embodiment, the engaging portion 182 may not be a through-hole. In this case, the engaging portion 182 may be a rod-shaped protrusion, and the engaged portion 168R may have a hole shape.

In the above embodiment, the engaging portion 182 may not be provided at the center of the pressure receiving portion 181. In this case, for example, the engaging portion 182 may be provided at a position between the center of the pressure receiving portion 181 and the shaft portion 185 in the Z axis direction, or may be provided at the coupling portion 184 of the displacement body 180. In the pressure chamber PC, the engaged portion 168R may be provided at a position where the engaged portion 168R can be engaged with the engaging portion 182.

In the above embodiment, the valve 172 may be provided with one notch portion 172R in the valve body 172B.

In the above embodiment, the valve 172 may not include the notch portion 172R in the valve body 172B. In this case, the supply chamber 166 may be provided with a plurality of protrusions as a regulating portion for restricting the movement of the valve 172 in the direction intersecting the X axis direction by contacting the outer peripheral surface of the valve 172.

In the above embodiment, the support portion 168H of the pressure chamber PC may not be provided at a position in the −Z direction with respect to the engaged portion 168R. In this case, for example, the support portion 168H may be provided at a position in the +Y direction with respect to the engaged portion 168R. In this case, the opening of the communication flow path 167 on the pressure chamber side may be provided at a position in the −Y direction with respect to the engaged portion 168R.

In the above embodiment, the support portion 168H of the pressure chamber PC may not be provided at a position in the −Z direction with respect to the engaged portion 168R. In this case, for example, the support portion 168H may be provided at a position in the +Z direction with respect to the engaged portion 168R. The rotation shaft 183 of the displacement body 180 may be provided so that the shaft portion 185 is located between the engaging portion 182 and the rotation shaft 183. At this time, the displacement body 180 may not rotate about the rotation shaft 183.

In the above embodiment, the displacement body 180 may not include the rotation shaft 183. In this case, the displacement body 180 may be provided with a pair of hemispherical protrusions at intervals in the Y axis direction so as to be supported by the support portion 168H.

In the above embodiment, the pressure receiving portion 181 of the displacement body 180 may be fixed to the flexible portion FP of the pressure chamber PC. In this case, the displacement body 180 may be formed of the same material as that of the layer of the second thin film 176 on the pressure chamber PC side. For example, the displacement body 180 may be formed of polypropylene, which is the same material as that of the layer of the second thin film 176 on the pressure chamber PC side, and the pressure receiving portion 181 of the displacement body 180 and the second thin film 176 may be fixed by heat welding.

In the above embodiment, the first thin film 175 may not be a multilayer film. In this case, the first thin film 175 may be a single-layer resin film or a metal film such as stainless steel.

In the above embodiment, the second thin film 176 may not be a multilayer film. In this case, the second thin film 176 may be a single-layer resin film or a metal film such as stainless steel. In addition, a flexible shape having a corrugated cross section may be provided in a portion of the second thin film 176 that constitutes the flexible portion PC.

In the above embodiment, the communication flow path 167 may not include the supply chamber side communication portion 167S. In this case, the communication flow path 167 may have a configuration in which the pressure chamber side communication portion 167T is open on the supply chamber 166 side, and even when the communication flow path 167 continuously extends from the supply chamber 166 side toward the pressure chamber PC side.

In the above embodiment, the communication flow path 167 may not include the pressure chamber side communication portion 167T. In this case, the communication flow path 167 may have a structure in which the supply chamber side communication portion 167S is open on the pressure chamber PC side, and the communication flow path 167 does not have to extend from the supply chamber 166 side toward the pressure chamber PC side.

What is claimed is:

1. A liquid ejecting apparatus comprising:

a liquid ejecting head that ejects liquid from a nozzle;

a liquid storage portion that includes a storage chamber configured to store the liquid supplied from a liquid supply source to the liquid ejecting head;

a carriage on which the liquid ejecting head and the liquid storage portion are mounted and configured to reciprocate in a scanning direction;

a discharge flow path communicating with the storage chamber and configured to discharge air in an upper part of the storage chamber;

a coupling portion configured to be coupled to and separated from a coupled portion of the discharge flow path; and a negative pressure generating portion that applies a negative pressure to the coupling portion, wherein when the carriage moves to a predetermined position, the coupling portion is coupled to the coupled portion of the discharge flow path.

2. The liquid ejecting apparatus according to claim 1, wherein a plurality of liquid storage portions are mounted on the carriage, a plurality of discharge flow paths corresponding to the plurality of liquid storage portions are merged in a middle to form a merged discharge flow path, and the coupling portion is coupled to a coupled portion of the merged discharge flow path as the coupled portion of the discharge flow path.

3. The liquid ejecting apparatus according to claim 1, further comprising:

a first opening/closing portion configured to open and close the discharge flow path, wherein the first opening/closing portion opens and closes the discharge flow path in conjunction with a movement of the carriage.

4. The liquid ejecting apparatus according to claim 3, further comprising:

a pressing portion configured to move in a direction of opening and closing the first opening/closing portion; and a lever that moves the pressing portion in conjunction with the movement of the carriage.

5. A liquid ejecting apparatus comprising:

a liquid ejecting head that ejects liquid from a nozzle;

a liquid storage portion that includes a filter chamber and configured to filter the liquid supplied form the liquid supply source by a filter, and a storage chamber provided downstream of the filter chamber in a liquid supply direction and configured to store the liquid supplied from a liquid supply source to the liquid ejecting head;

a carriage on which the liquid ejecting head and the liquid storage portion are mounted and configured to reciprocate in a scanning direction;

a discharge flow path that includes a first discharge flow path configured to discharge air in an upper part of the storage chamber and a second discharge flow path configured to discharge air in at least one of an upper part of the filter chamber and an upstream flow path located upstream in the liquid supply direction from the filter in the liquid storage portion;

a coupling portion configured to be coupled to and separated from a coupled portion of the discharge flow path; and a negative pressure generating portion that applies a negative pressure to the coupling portion, wherein when the carriage moves to a predetermined position, the coupling portion is coupled to the coupled portion of the discharge flow path.

6. The liquid ejecting apparatus according to claim 5, wherein a plurality of liquid storage portions are mounted on the carriage, a plurality of first discharge flow paths and a plurality of second discharge flow paths corresponding to the plurality of liquid storage portions are merged in a middle to form a merged discharge flow path, and the coupling portion is coupled to a coupled portion of the merged discharge flow path as the coupled portion of the discharge flow path.

7. The liquid ejecting apparatus according to claim 5, further comprising:

a first opening/closing portion configured to open and close the first discharge flow path; and a second opening/closing portion configured to open and close the second discharge flow path, wherein the first opening/closing portion and the second opening/closing portion open and close the first discharge flow path and the second discharge flow path in conjunction with a movement of the carriage.

8. The liquid ejecting apparatus according to claim 7, further comprising:

a pressing portion configured to move in a direction of opening and closing the first opening/closing portion and the second opening/closing portion; and a lever that moves the pressing portion in conjunction with the movement of the carriage.

9. The liquid ejecting apparatus according to claim 1, wherein the coupling portion extends in the scanning direction at the predetermined position, and the coupled portion of the discharge flow path is open to a position facing the coupling portion in the scanning direction.

10. The liquid ejecting apparatus according to claim 1, further comprising:

an on-off valve provided at the coupled portion of the discharge flow path and configured to open and close the discharge flow path; and a biasing portion that biases the on-off valve in a direction of closing the coupled portion of the discharge flow path, wherein when the carriage moves to the predetermined position, the coupling portion is inserted into the discharge flow path while pressing the on-off valve against a biasing force of the biasing portion, and thus the discharge flow path is opened and the discharge flow path and the coupling portion communicate with each other.

11. The liquid ejecting apparatus according to claim 1, further comprising:

a cap configured to form a closed space to which the nozzle is open, wherein the negative pressure generating portion communicates with the cap.

12. A control method of a liquid ejecting apparatus that includes a liquid ejecting head ejecting liquid from a nozzle, a liquid storage portion having a storage chamber configured to store the liquid supplied from a liquid supply source to the liquid ejecting head, a carriage on which the liquid ejecting head and the liquid storage portion are mounted and configured to reciprocate in a scanning direction, a discharge flow path configured to discharge air in an upper part of the storage chamber, a first opening/closing portion configured to open and close the discharge flow path, a pressing portion configured to move in a direction of opening and closing the first opening/closing portion, a lever moving the pressing portion in conjunction with a movement of the carriage, an on-off valve provided at a coupled portion of the discharge flow path and configured to open and close the discharge flow path, a coupling portion configured to be coupled to and separated from the coupled portion of the discharge flow path, and a negative pressure generating portion applying a negative pressure to the coupling portion, the method comprising:

opening the on-off valve at the coupling portion, and coupling the coupling portion to the coupled portion of the discharge flow path by moving the carriage to a front of a predetermined position;

moving the lever in a direction of pressing the pressing portion to open the first opening/closing portion by moving the carriage to the predetermined position; and sucking the air in the storage chamber via the discharge flow path by applying a negative pressure to the coupling portion by the negative pressure generating portion.

* * * * *